US005814439A

United States Patent [19]

Ohshima et al.

[11] Patent Number: 5,814,439

[45] **Date of Patent: *Sep. 29, 1998**

[54] SILVER HALIDE COLOR PHOTOGRAPHIC PHOTO-SENSITIVE MATERIAL

[75] Inventors: Naoto Ohshima; Mitsuo Saitou, both of Kanagawa, Japan

[73] Assignee: Fuji Photo Film Co., Ltd., Minami-ashigara, Japan

[ * ] Notice: The term of this patent shall not extend beyond the expiration date of Pat. No. 5,449,596.

[21] Appl. No.: 739,517

[22] Filed: Oct. 29, 1996

Related U.S. Application Data

[63] Continuation of Ser. No. 466,139, Jun. 6, 1995, abandoned, which is a continuation of Ser. No. 220,670, Mar. 31, 1994, abandoned.

[30] Foreign Application Priority Data

| | | | |
|---|---|---|---|
| Apr. 2, 1993 | [JP] | Japan | 5-100418 |
| Oct. 8, 1993 | [JP] | Japan | 5-277719 |

[51] Int. Cl.[6] ..... G03C 1/08; G03C 1/34

[52] U.S. Cl. ..... 430/567; 430/604; 430/605; 430/611; 430/613; 430/615

[58] Field of Search ..... 430/543, 567, 430/604, 605, 615, 611, 613

[56] References Cited

U.S. PATENT DOCUMENTS

| | | | |
|---|---|---|---|
| 4,917,994 | 4/1990 | Martinez et al. | 430/543 |
| 5,187,053 | 2/1993 | Hayashi | 430/600 |
| 5,204,234 | 4/1993 | Asami | 430/567 |
| 5,217,857 | 6/1993 | Hayashi | 430/567 |
| 5,252,456 | 10/1993 | Ohshima et al. | 430/605 |
| 5,264,337 | 11/1993 | Maskasky | 430/567 |
| 5,275,930 | 1/1994 | Maskasky | 430/567 |
| 5,284,743 | 2/1994 | Ohshima et al. | 430/567 |
| 5,314,798 | 5/1994 | Brust et al. | 430/567 |
| 5,320,938 | 6/1994 | House et al. | 430/567 |
| 5,449,596 | 9/1995 | Kawai et al. | 430/508 |

FOREIGN PATENT DOCUMENTS

| | | |
|---|---|---|
| 0 315 109 | 5/1989 | European Pat. Off. . |
| 0 331 004 | 9/1989 | European Pat. Off. . |
| 0534395 | 3/1993 | European Pat. Off. . |
| 0854644 | 3/1994 | European Pat. Off. . |
| 0 617 317 | 9/1994 | European Pat. Off. . |
| 3-1135 | 5/1989 | Japan . |
| 3-209243 | 6/1993 | Japan . |
| 5-307246 | 11/1993 | Japan . |

*Primary Examiner*—Thorl Chea

*Attorney, Agent, or Firm*—Burns, Doane, Swecker & Mathis, LLP

[57] ABSTRACT

In a silver halide color photographic photo-sensitive material comprising a reflective support having thereon photographic structural layers comprising one or more silver halide emulsion layers, pH of a coating of the silver halide color photographic photo-sensitive material ranges from 4.0 to 6.5 and at least one of the silver halide emulsion on layers contains at least one mercapto heterocyclic compound and tabular silver halide grains having {100} planes was main planes and having a silver chloride content of not less than 80 mol %, the silver halide grains containing at least one selected from the group consisting of metal complexes of Fe, Ru, Re, Os, Rh and Ir.

10 Claims, No Drawings

SILVER HALIDE COLOR PHOTOGRAPHIC PHOTO-SENSITIVE MATERIAL

This application is a continuation of application Ser. No. 08/466,139, filed Jun. 6, 1995, now abandoned, which is a continuation of application Ser. No. 08/220,670, filed Mar. 31, 1994, now abandoned.

BACKGROUND OF THE INVENTION

This invention relates to a silver halide color photographic photo-sensitive material. More particularly, the present invention relates to a silver halide color photographic photo-sensitive material which is highly sensitive to light, is excellent in storability and is improved in pressure induced desensitization.

Color photography is a process of producing dye images achieved by using a photo-sensitive material comprising a support having thereon photographic structural layers comprising a silver halide emulsion and dye forming couplers. The photo-sensitive material is subjected to color development processing with an aromatic primary amine color developing agent, resulting in production of an oxidation product of the developing agent. The dye images are formed by reaction of this oxidation product with the dye forming couplers.

Simplified and rapid color development processing is a strong requirement of the color photographic field and various improvements have been achieved. Advanced faster systems have been developed one after another in a cycle of a few years.

To increase a processing speed requires a further approach to shortening time for each of color development, bleach-fixing, washing with water and drying processes. A method of increasing the processing speed is disclosed in, for example, International Patent Publication No. WO 87/04534. This publication discloses a method of rapid processing by using, as a photographic emulsion, a color photographic photo-sensitive material comprising silver halide with higher contents of silver chloride. From the viewpoint of the rapid processing, it would be preferable to use the emulsion with the higher contents of the silver chloride.

Such efforts yield a technique of printing images of a color negative on a silver halide color photographic printing paper for silver halide based printing, which has become a common method for simple and easy production of high-quality images.

The higher contents of the silver chloride in the silver halide emulsion to be used result in a far advance in a development speed. The silver chloride emulsion is, however, found to have a disadvantage of lower photo-sensitivity. With this respect, various techniques and methods are disclosed to improve the photo-sensitivity of such silver halide emulsion having a high silver chloride content (hereinafter, referred to as "high silver chloride emulsion"), and thereby to overcome the above mentioned problem.

European Patent Publication No. 0,534,395A1 discloses that a higher sensitivity can be achieved by using tabular grains having {100} crystallographic planes as main planes.

The present inventor prepared the tabular grains having {100} planes as main planes to study and examine availability of a highly sensitive high silver chloride emulsion. As a result, it has revealed that the high silver chloride emulsion containing tabular grains having {100} planes as main planes is highly photo-sensitive but photo-sensitive materials to which the emulsion in question is applied are suffered from a problem of increase of fogging density during a long period of storage. There is a noticeable increase in the fogging density of the photo-sensitive material during the long period of storage when a color developer contaminated with a bleach-fixing solution is used during a continuous color processing. This is a serious problem in practical applications considering a storage period up to when the photo-sensitive material is used, after being prepared, in the field of processing laboratory as well as considering a possibility of change in composition of a processing solution.

As a method of achieving this high sensitivity, for example, JP-A-2-20853 (the term "JP-A" as used herein means an "unexamined" published Japanese patent application) discloses that the high sensitivity can be achieved by means of doping a high silver chloride emulsion with a six-coordination complex of Re, Ru or Os having at least four cyan ligands. JP-A-1-105940 discloses that an emulsion having excellent reciprocity law properties can be obtained without deterioration of latent image stability at a few hours after exposure by using an emulsion layer having the high contents of the silver chloride which includes silver bromide rich regions in which iridium (Ir) is selectively doped. JP-A-3-132647 discloses that a high silver chloride emulsion that contains iron ions contributes to production of a highly sensitive, hard gradation photo-sensitive material of which sensitivity is less affected by fluctuation of temperature or intensity of illumination during exposure, and contributes to reduction of pressure induced desensitization of the material when pressure is applied to it. JP-A-4-9034 and JP-A-4-9035 disclose that such a photo-sensitive material can be obtained that is highly sensitive and is less in reciprocity, and that has good latent image storability with less pressure fogging by using a high silver chloride emulsion that contains a specific metal complex having at least two cyan ligands. JP-A-62-253145 discloses that such a silver halide photographic photo-sensitive material can be obtained that is less affected by the pressure fogging or the pressure induced desensitization and that is suitable for rapid processing by means of containing metal ions in the high silver chloride emulsion having a bromide rich phase.

On the other hand, JP-A-2-6940 and U.S. Pat. No. 4,917,994 disclose that increase of fogging of photo-sensitive materials can be restricted by means of adjusting pH of the coating (photographic structural layers) of the materials. In addition, JP-A-2-135338 and JP-A-3-1135 disclose that to keep pH of a coating of photo-sensitive materials at a specific level restricts fogging and change in photo-sensitivity during storage of the photo-sensitive material.

However, none of the above mentioned known techniques has led to a method of restricting increase of the fogging density and the pressure induced desensitization of the aforementioned specific high silver chloride emulsions, especially increase of the fogging density after a long period of storage that becomes notable when the color developer contaminated with a bleach-fixing solution is used.

Accordingly, an object of the present invention is to provide a silver halide color photographic photo-sensitive material which is highly sensitive to light, is excellent in storability and is improved in pressure induced desensitization

SUMMARY OF THE INVENTION

The present invention is achieved with a silver halide color photographic photo-sensitive material comprising a reflective support having thereon photographic structural layers comprising one or more silver halide emulsion layers, wherein pH of a coating (the photographic structural layers) of the silver halide color photographic photo-sensitive material ranges from 4.0 to 6.5 and wherein at least one of the silver halide emulsion layers contains at least one mercapto heterocyclic compound and tabular silver halide grains having {100} planes as main planes and a silver chloride content of 80 mol % or higher, the silver halide grains containing at least one selected from the group consisting of metal complexes of Fe, Ru, Re, Os, Rh and Ir.

In the present invention, it is preferable that, in the high silver chloride emulsion layer containing the tabular silver halide grains, 35%–100% of a total projection area of all silver halide emulsion grains therein is occupied by tabular silver halide grains having an aspect ratio (diameter/thickness) of 1.5 or greater, each tabular silver halide grain having at least one gap phase discontinuous in halogen composition at a central portion thereof, said gap being a difference of 10 to 100 mol % in $Cl^-$content or $Br^-$content and/or a difference of 5 to 100 mol % in $I^-$content. In addition, the metal complex is preferably Ir complex that has at least two cyan ligands. Preferable metal complex is represented by the following general formula:

$$[M^1(CN)_{6-a}L_a]^n,$$

wherein $M^1$ represents Fe, Ru, Re, Os or Ir, L represents a ligand other than CN, a represents 0, 1 or 2, and n represents −2, −3 or −4.

The mercapto heterocyclic compound is preferably a compound represented by the following general formula:

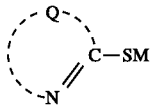

wherein Q represents atomic groups necessary for forming a five- or six-membered heterocyclic ring or five- or six-membered heterocyclic ring to which a benzene ring is condensed, and M represents a cation.

The silver halide color photographic photo-sensitive material according to the present invention can achieve the higher photo-sensitivity, restrict increase of the fogging density during a long storage period of the photo-sensitive material and improve the pressure induced desensitization.

It is not expected from the above mentioned related arts that a combination of a specific metal complex contained and pH adjustment of the coating of the materials to a specific level results in restriction of increase of the fogging density of the tabular silver halide emulsion having such the high silver chloride content (hereinafter, referred to as "tabular high silver chloride emulsion") that has {100} planes as main planes, especially increase of the fogging density after a long period of storage that becomes notable when the color developer contaminated with a bleach-fixing solution.

DETAILED DESCRIPTION OF THE INVENTION

Silver chloride content of tabular silver halide grains each having {100} planes as main planes and having the silver chloride content of not less than 80 mol %, used in the present invention, is preferably 90 mol % or higher, and most preferably, 95 mol % or higher.

The silver halide emulsion used in the present invention contains at least a dispersion medium and the above mentioned silver halide grains. The emulsion layer contains silver halide grains, in which 10% or more, and preferably 35–100%, and more preferably 60–100%, of a total projection area of all silver halide grains is occupied by tabular silver halide grains having {100} planes as main planes. The term "projection area" used herein means a projection area of the grains obtained when the silver halide emulsion grains are arranged on a substrate with not being overlapped with each other and with the tabular grains of which main planes are oriented in parallel to a surface of the substrate. In addition, the term "main planes" used herein means two parallel and largest outer planes of one tabular grain. The aspect ratio (diameter/thickness) of the tabular silver halide grain is 1.5 or greater, preferably 2 or greater, more preferably from 3 to 25, and most preferably from 3 to 7. The term "diameter" used herein means a diameter of a circle having an area that is equal to the projection area of the grain when observed through an electron microscope. The term "thickness" used herein means a distance between the main planes of the tabular grain. The diameter of the tabular silver halide grain is preferably 10 μm or smaller, and more preferably 0.2–5 μm, and most preferably 0.2–3 μm. The thickness is preferably 0.7 μm or smaller, more preferably 0.03–0.3 μm, and most preferably 0.05–0.2 μm. A grain size distribution of the tabular grains is preferably monodisperse and the coefficient of variation is preferably 40% or lower, and more preferably 20% or lower.

The tabular high silver chloride grains having {100} planes as main planes may be prepared by using a method disclosed in European Patent No. 0,534,395A1, page 7, line 53 to page 19, line 35 or a method disclosed in JP-A-4-214109, paragraphs 0006 to 0024. Each grain is, however, uniform in composition or gradually varied from the center to the periphery rather than having a gap phase discontinuous in halogen composition at a central portion thereof. With the uniform or gradually varying composition, it is difficult to prepare one type of tabular grains separating from others during preparation thereof. This may cause product variation. In addition, size distribution becomes wider and the resultant product may become unsuitable in image-quality such as sensitivity, gradation or granular properties.

To overcome these problems, the grain preferably has a gap phase discontinuous in halogen composition at a center thereof. The number of such the gap phase is one or more, preferably from two to four, and more preferably two. The term "central portion" used herein means at and around the center rather than only the right in the center. Such the gap phase located closer to the right center is more preferable in view of forming the tabular grain having the higher aspect ratio.

1) Specific example wherein the grain has one gap phase discontinuous in halogen composition This specific example may be, for example, AgBr laminated on an AgCl nucleus (AgCl/AgBr), AgBrI laminated on an AgCl nucleus (AgCl/AgBrI) or AgBr laminated on an AgClBr nucleus (AgClBr/AgBr). A general representation thereof is ($AgX^1/AgX^2$). In this event, $X^1$ and $X^2$ are different from each other in the contents of $Cl^-$ or $Br^-$ by from 10 to 100 mol %, preferably from 30 to 100 mol %, more preferably from 50 to 100 mol % and most preferably from 70 to 100 mol %.

2) Specific example wherein the grain has two gap phases discontinuous in halogen composition According to the above mentioned explanatory rule, this specific example may be, for example, (AgBr/AgCl/AgBr), (AgCl/AgBr/AgCl), (AgBrI/AgCl/AgBrI) or (AgCl/

AgClBr/AgCl). A general representation thereof is ($AgX^1$/$AgX^2$/$AgX^3$). $X^1$ may be same as or different from $X^3$. The differences in the halogen composition of the individual layers are the same as in specific example 1).

The gap phase has a difference in the halogen composition. More specifically, this means stepwise change at the phase in the halogen composition caused by varying the halogen composition of a halogen salt solution (hereinafter, referred to as "$X^-$ salt solution") to be added or that of silver halide grains to be added, and construction itself of the grains is not a matter of consideration. The gap phase is preferably different in the $Br^-$ content rather than the $I^-$ content. In addition, the tabular grain preferably has two gap phases discontinuous in $Br^-$ content.

In this event, a first formed silver halide grain has a diameter of preferably not larger than 0.15 μm, and more preferably from 0.02 to 0.1 μm, and most preferably from 0.02 to 0.06 μm according to a stereographic projection of the grain.

The $AgX^2$ layer has a thickness that corresponds to, preferably an amount capable of covering one or more lattice layers on the $AgX^1$ layer in average, and more preferably from an amount capable of covering three lattice layers to a molar amount ten times larger than that of the $AgX^1$ layers, and most preferably from an amount capable of covering ten lattice layers to a molar amount three times larger than that of the $AgX^1$ layers. The number of the gap phases and composition of each layer are preferably same in all grains. This is because such equivalent-gap phase configuration of the grains permits formation of grains that are same in the number of screw dislocations per grain and formation of tabular grains of which sizes are distributed in a relatively narrow range accordingly.

A shape of the major face of the tabular grain may be a right-angled parallelogram (a ratio between adjacent sides, i.e., long-side/short-side, of one grain is preferably from 1 to 10, more preferably from 1 to 5, and most preferably from 1 to 2), a shape obtained by asymmetrically notching four corners of a right-angled parallelogram (of which detail is disclosed in Japanese Patent Application No. 4-145031), or a shape in which at least two opposing sides of four sides forming the major plane are approximated by convex curves.

METHOD OF MANUFACTURING TABULAR SILVER HALIDE EMULSION GRAINS ACCORDING TO THE PRESENT INVENTION

The tabular silver halide emulsion grains can be manufactured through at least seed formation and ripening process.

First, seed formation process is described.

(1) Seed formation Process $AgNO_3$ solution and a solution of a halogen compound salt (hereinafter, referred to as "$X^-$") are added to a solution of dispersion medium containing at least a dispersion medium and water to form a seed while stirring.

During this seed formation, defect arises that may be a cause of anistropic growth of the grain. This type of defect is called screw dislocation in the present invention. To form the screw dislocation, a nucleation atmosphere should be a {100}-plane forming atmosphere to ensure that the nucleus is bounded by {100} planes. A silver chloride seed is bounded by the {100} planes under normal conditions without specific adsorbents and specific conditions. Accordingly, the screw dislocations can be formed under normal conditions. The term "specific adsorbents and specific conditions" used herein means conditions where a twinning plane is formed or conditions where an octahedral AgCl grain is formed. Such specific conditions are disclosed in, for example, U.S. Pat. Nos. 4,399,215, 4,414,306, 4,400,463, 4,713,323, 4,804,621, 4,783,398, 4,952,491 and 4,983,508; Journal of Imaging Science, Vol. 33, page 13 (1989) and Vol. 34, page 44 (1990); and Journal of Photographic Science, Vol. 36, page 182 (1988).

On the other hand, a silver bromide seed is seed bounded by {100} planes only under limited conditions. More specifically, the conditions are those known in the art to form a cubic or a tetradecahedral AgBr grain. The screw dislocations may be formed under these conditions. In this event, $x^1$, or [area of (111) planes/area of {100} planes] is preferably from 1 to 0, and more preferably from 0.3 to 0, and most preferably from 0.1 to 0. Characteristic of AgBrCl grains is considered to be varied in proportion to the $Br^-$ contents. Accordingly, the higher the $Br^-$ contents are, the more the seed formation conditions are restricted. The area ratio may be measured by using, for example, a method applying plane-selective adsorption dependency of the (111) and {100} planes of sensitizing dyes (T. Tani, Journal of Imaging Science, Vol. 29, page 165 (1985)).

During the seed formation , {100} plane formation promoters may be contained in the dispersion medium to enhance formation of the {100} planes. Specific examples of the promoter compounds and method of usage can be referenced in European Patent No. 0,534,395A1. In summary, $10^{-5}$ to 1 mol/L, preferably $10^{-4}$ to $10^{-1}$ mol/L of adsorbents including N atoms having resonance-stabilized π electron pairs are contained in the dispersion medium. In addition, pH is set at a value not smaller than pH at (pKa value of the compound −0.5), preferably not smaller than the pKa value, and more preferably not smaller than (pKa value +0.5).

In the seed formation, concentration of the dispersion medium in the dispersion medium solution ranges from 0.1% to 10%, by weight, and preferably from 0.2% to 5%, by weight; pH ranges from 1 to 12, preferably from 2 to 11, and more preferably from 5 to 10; and $Br^-$ concentration is $10^{-2}$ mol/L or lower and preferably $10^{-2.5}$ mol/L or lower. Temperature is preferably 90° C. or lower, and more preferably from 15° to 80° C. $Cl^-$ concentration is preferably $10^{-1}$ mol/L or lower. In the above ranges, L represents a liter.

The seed is formed in a seed {100}-plane forming atmosphere and then the screw dislocation is caused in the seed. In the present invention, the screw dislocation is caused in the seed by means of forming one or more, preferably from two to four, and most preferably two gap phases discontinuous in halogen compositions in the nucleus. In other words, the screw dislocation is forcedly caused in the seed by using a difference in lattice constant between adjacent layers on both sides of the gap phase. This method is superior in manufacture reproducibility to a method disclosed in European Patent No. 0,534,395. This patent discloses incorporation of $I^-$ having extremely large ion diameter into an AgCl lattice and also discloses a method through coagulation of the nuclei. These methods are, however, disadvantageous in efficiency. In addition, incorporation of $I^-$ into AgCl deteriorate processing capability of the developing solution and is thus unfavorable. Further, uniform composition of AgClBr or AgBrI hardly contains the screw dislocation, which limits choice of available systems.

Describing the present invention more specifically, halogen composition of the $X^-$ salt solution is changed stepwise during a seed formation period in formation of the seed by means of adding a silver salt solution and an $X^-$ solution to the dispersion medium according to a double-jet addition method. For example, the seed formation period is divided into two stages and the halogen composition of the $X^-$ salt solution added in a latter stage is varied stepwise from that of the $^-$ salt solution added in a former stage according to the above mentioned halogen composition differences. Alternatively, the seed formation period is divided into three stages and the halogen compositions of the $X^-$ salt solutions added in the individual stages are varied stepwise according to the above mentioned halogen composition differences. In this way, seed formation period is divided into n stages (n is a positive integer equal to or larger than 1) and the halogen composition of the $X^-$ salt solution added in a second or subsequent stage is varied stepwise from that in a previous stage according to the above mentioned halogen composition differences. The number of the screw dislocations formed per grain (=a) depends on the above mentioned halogen composition difference, the thickness of the $AgX^1$, $AgX^2$ and $AgX^3$ layers, pH during the seed information, pAg, temperature, concentration of the dispersion medium, concentration of the adsorbent and so on.

The seed formation may be made under conditions of infrequent growth of prismatic (acicular) or twining seeds containing one screw dislocation as well as seeds containing growth promotion defect in a three-dimensional direction and under conditions where the tabular grain seeds are grown at a high frequency. Most preferable conditions may be obtained through an experimental try-and-error procedure depending on individual applications. To avoid formation of the twining grains, the above mentioned adsorbent that adsorbs selectively on the {100} plane is preferably used together.

In the seed formation, a dispersion medium may be contained previously in the silver salt solution and/or the $^-$ salt solution which should be added to the dispersion medium solution in order to permit uniform seed formation. Concentration of the dispersion medium in these salt solution(s) is preferably 0.1%, by weight, or higher, more preferably from 0.1% to 2%, by weight, and most preferably from 0.2% to 1%, by weight. As the dispersion medium, gelatin having a low molecular weight of 3000–50,000 is preferably used.

On the other hand, concentration of the dispersion medium added to a reaction vessel is preferably 0.1%, by weight, or higher, more preferably from 0.2% to 5%, by weight, and most preferably from 0.3% to 2%, by weight. The solution in the reaction vessel has pH of from 1 to 12, preferably from 3 to 10, and more preferably from 5 to 10.

(2) Ripening

In the seed formation, it is impossible to form only the tabular grain seeds. With this respect, the grains other than the tabular grains are disappeared through Ostwald ripening in a subsequent ripening process. A ripening temperature is preferably at least 10° C. higher, and more preferably at least 20° C. higher than a seed formation temperature. The ripening temperature generally ranges from 50° to 90° C., and preferably from 60°to 80° C. At a ripening temperature of 90° C. or higher, the ripening process is preferably made under pressure of at least 1.2 times higher than the atmospheric pressure. Details of this pressurized ripening can be referenced in JP-A-5-173267. The ripening process is preferably made in the {100}-plane forming atmosphere. More specifically, the grains are preferably subjected to ripening under the above defined cubic- or tetradecahedral-crystal forming atmosphere.

When the $Br^-$ content in the seed is preferably 70 mol % or higher, and more preferably 90 mol % or higher, an excessive ion concentration of $Ag^+$ and $Br^-$ in the solution during ripening is preferably $10^{-2.3}$ mol/L or lower, and more preferably $10^{-2.6}$ mol/L or lower. The solution has pH of preferably 2 or higher, more preferably from 2 to 11, and most preferably from 2 to 7. During the ripening under these pH and pAg conditions, fine cubic grains containing no defect are mainly disappeared and the tabular grains are grown in an edge direction preferentially. As it is deviated from the excessive ion concentration condition, the preferential growth of edges becomes weak and a rate of non-tabular grain disappearance becomes slow. In addition, a ratio of growth of the major faces of the grain is increased, reducing the aspect ratio of the grain. In the ripening process, the ripening can be improved by means of co-existing AgX solvents. In this event, this condition varies depending on, for example, the halogen composition of the AgX grains, pII, pAg, gelatin concentration, temperature and AgX solvent concentration. Accordingly, an optimum condition may be determined through try-and-error procedures depending on the individual applications.

When the $Cl^-$ content in the nucleus is preferably 30 mol % or higher, more preferably 60 mol % or higher, and most preferably 80 mol % or higher, an excessive ion concentration of $Cl^-$ in the solution during ripening is preferably 3 or smaller, more preferably from 1 to 2.5, and most preferably from 1 to 2 in a pCl value. The solution has pH of preferably from 2 to 11, and more preferably from 3 to 9.

The ripening may also be performed while adding the silver salt solution and the $X^-$ salt solution to the dispersion medium under low supersaturating condition according to the double-jet method. Under the low supersaturating condition, growth active points containing the screw dislocations are grown in preference to fine grains containing no defect, which are disappeared during the ripening process. This is because supersaturation required for forming at the growth active point a semi-stable nucleus for grain growth is low but is higher than the supersaturation required for forming the same semi-stable nucleus on a non-defective surface. The term "low supersaturating" used herein means preferably 30% or lower, and more preferably 20% or lower of the supersaturation in a critical addition. The phrase "the supersaturation in a critical addition" used herein means the degree of supersaturation at the time when the silver salt solution and the $X^-$ salt solution are added at a critical addition speed, over which a new nucleus will be formed.

The grains obtained after completion of the ripening process may be used as the emulsion in this invention. However, a following crystal growing process is typically provided by the considerations that a grown amount (mol/L) of the AgX grains is small and that arbitrary selection of the grain size cannot be made.

(3) Crystal Growing Process

In the ripening process, the ratio of the tabular grains is increased and each grain is then grown to a desired size. The grains are grown under conditions where the tabular grains are bounded by the above defined {100} planes. In this event, an applicable method may be: 1) an ion solution adding method to grow with addition of the silver salt solution and the $X^-$ salt solution; 2) a fine grain adding method to grow the grains by means of adding fine AgX grains previously formed; and 3) a combination thereof.

To grow the tabular grains in the edge direction preferentially, the grains may be grown under the low supersaturating conditions. The term "low supersaturating"

used herein means preferably 35% or lower, and more preferably 2–20% or lower of the supersaturation in the critical addition.

Typically, the lower the degree of supersaturation becomes, the wider the grain distribution range. An explanation for this is as follows. Solute ions collide with grain surfaces less frequently and thus there is less chance of growing nuclei formation under the low supersaturating condition. Accordingly, process of the growing nuclei formation is in a growth rate determination. A probability of the growing nuclei formation is in proportion to an area of growing plane of the grain under a uniform solution condition, and grains having the larger area of growing planes grow more rapidly. Accordingly, the larger grains grow more rapidly than the smaller grains, which broadens the distribution of the grain sizes. This growth behavior is observed in normal crystal grains having no twining plane and in tabular grains having parallel twining planes. More specifically, for the normal crystal grain, a linear growth rate is in proportion to a surface area. For the parallel-twining tabular grains, it is in proportion to a peripheral length of the edge (i.e., a length of a trough line).

On the other hand, in the grains according to the present invention, only the screw dislocations (d1) serve as growth starting points in edge planes of the grain. The frequency of the growing nuclei formation is in proportion to the number of d1. Accordingly, the grains are expected to grow uniformly even under the low supersaturating condition when each grain contains the same number of d1. As the average grain size increases, the fluctuation coefficient becomes small. The number of d1 per grain become equal to each other when the sizes of the nuclei grown during the formation of the nuclei are uniform and inter-grain properties of the gap phase are uniform. To form the nuclei having the same size, formation of new nuclei is performed during a short period and the nuclei are grown at a high supersaturating concentration without formation of additional nuclei. Small grains having the same size can result from processing at a low temperature. The term "low temperature" used herein is a temperature of not higher than 50° C., preferably from 5° to 40° C., and more preferably from 50° to 30° C. In addition, the term "short period" used herein means preferably 3 minutes or shorter, more preferably 1 minute or shorter, and most preferably from 1 to 20 seconds.

When the tabular grains are grown under the low supersaturating conditions, a monomer of the solute ion adsorbing on the major face of the grain is desorbed therefrom before it grows to a dimer through n-mer and creates an adsorption/desorption equilibrium. The monomer is taken into the edge. More specifically, chemical equilibrium of the solute ions among on the major face, in a solution phase and on edge planes is considered according to an energy diagram. A van't Hoff's constant-pressure equilibrium equation, $d\ln Kp/dT=\Delta H^0/RT_2$ is applied to the energy diagram. This van't Hof's equation is obtained according to $\Delta G^0=-RT\ln Kp$ which is derived from the GibbsHelmholtz equation and a chemical equilibrium equation. By using van't Hoff's equation, the chemical equilibrium of the solute ions can be understood with temperature change plotted relative to grown lengths of the major face and the edge plane. Typically, the higher temperature promotes desorption of the solute ions adsorbed on the major face, which permits further selective growth of the edges. Let Kp be [a grown length of the edge plane/a grown length of the major face], then $\Delta H$ is approximately 13 kCal/mol.

The higher the degree of supersaturation in the crystal growth is, the more frequent the growing nuclei are formed on the non-defective planes. In other words, the tabular grain also grows in a width direction and the resultant tabular grain has a lower aspect ratio. This suggests that the grain growth goes on in a polynuclei-growing manner. Further increase of the supersaturation degree provides more change of the growing nuclei formation. This continuously varies to a diffused rate-determining growth.

With a fine grain emulsion adding method, fine AgX grain emulsion is added in which a diameter of each grain is not larger than 0.15 μm, preferably not larger than 0.1 μm, and most preferably from 0.06 to 0.006 μm. Subsequently, the tabular grains are grown through the Ostwald ripening. The fine grain emulsion may be added continuously or intermittently. The fine grain emulsion may be prepared continuously by means of supplying the $AgNO_3$ solution and the $X^-$ salt solution in a mixer provided near the reaction vessel and may be added immediately and continuously to the reaction vessel. Alternatively, the fine grain emulsion may be prepared through a batch process in a separate vessel and may be added continuously or intermittently to the reaction vessel. The fine grain emulsion may be added in a form of liquid or in a form of dried powder. The fine grains are preferably contain substantially no multi-twining grain. The term "multi-twining grain" used herein means a grain that contains two or more twining planes. The grains containing substantially no multi-twining grain means a grain having multi-twining grain content of not higher than 5%, preferably not higher than 1%, and more preferably not higher than 0.1%. In addition, it is preferable that the fine grains contain substantially no twining plane. Further, it is preferable that the fine grains contain substantially no screw dislocation. The term "contain substantially no" means as defined above.

The halogen composition of the emulsion may be different from grain to grain or same for all grains. However, to use an emulsion comprising the grains having the same halogen composition facilitates achievement of uniform properties of the grains. The tabular grains according to the present invention may have a halogen composition distribution in a tabular grain growing process along with the gap phase required to form a tabular nucleus. An example of grains includes so-called core-shell grains comprising a core in the internal part of the silver halide grain and a shell (one or more layers) enclosing the core which are different from each other in the halogen composition. Alternatively, also applicable are any other grains having two or more non-layer phases in the internal part or on the surface thereof which are different from each other in the halogen composition. The non-layer phase on the surface of the grain, if any, results from bonding of a layer having unlike composition to an edge, a corner or a surface. These grains can advantageously be used for achieving high sensitivity and are also preferable by the pressure resistant considerations. When the silver halide grains having the above mentioned structure are used, a boundary between adjacent phases that are different from each other in the halogen composition may be a distinct boundary or an indistinct boundary with mixed crystals formed due to a difference in composition. In addition, the silver halide grain may be provided with actively a continuous structural change.

In the high silver chloride emulsion according to the present invention, the grain preferably has a silver bromide localized phase of a layer shape or a non-layer shape in the internal part or on the surface of the silver halide grain along with the gap phase required to form a tabular nucleus. The halogen composition of the above mentioned localized phase is preferably at least 10 mol %, and more preferably higher than 20 mol %, based on the silver bromide content. The localized phase may exist in the internal part, on an edge, corner or surface of the grain. A preferable example of the localized phase is grown epitaxially on the corner of the grain.

The above mentioned mono-disperse emulsions may be blended in a same layer or laminated to achieve a wide latitude.

All silver halide emulsions used in the present invention are subjected to normal chemical sensitization and spectral sensitization.

For the chemical sensitization method, it is possible to use simultaneously chemical sensitization with chalcogens such as sulfur sensitization, selenium sensitization and tellurium sensitization, noble metal sensitization represented by gold sensitization, and reduction sensitization. Compounds advantageously used in the chemical sensitization are disclosed in JP-A-62-215272, page 18, a lower right column, to page 22, an upper right column.

The spectral sensitization is directed to apply spectral sensitivity to a desired range of wavelength to the emulsion in each layer of the photo-sensitive material according to the present invention. In the present invention, it is preferable that the spectral sensitization is applied by means of adding dyes—spectral sensitized dyes to the emulsion that absorb light having wavelengths involved in target spectral sensitivity. The spectral sensitized dyes used are disclosed in, for example, John Heterocyclic compounds-Cyanine dyes and related compounds, John Wiley & Sons, New York/London, 1964. Specific example of the compounds and a method of the spectral sensitization are disclosed in the above mentioned specification, JP-A-62-215272, page 22, an upper right column to page 38.

Various compounds and precursors thereof may be added to the silver halide emulsion used in the present invention to avoid fogging during manufacture process, storage or photographic processing of the photo-sensitive material or to stabilize photographic performance. A specific example of these compounds is disclosed in JP-A-62-215272, pages 39–72.

The emulsion used in the present invention is a so-called surface latent image type emulsion with which latent images are mainly formed on the surface of the grains.

The silver halide grains according to the present invention contain the metal complex of Fe, Ru, Re, Os or Ir.

An amount of the metal complex added varies depending on the type thereof but is preferably in a range from $10^{-9}$ mol to $10^{-2}$ mol, and more preferably in a range from $10^{-8}$ mol to $10^{-4}$ mol per one mol of the silver halide.

The metal complex used in the present invention may be added to the silver halide grains in any stages before and after preparation of them, i.e., the nucleation, growth, physical ripening and chemical sensitization. The metal complex may be added at once or at several times. The metal complex used is preferably dissolved in water or an adequate solvent.

Of the metal complexes applicable to the present invention, iridium complex is especially preferable. Following are examples of trivalent or tetravalent iridium complex used to contain the iridium complex in the silver halide emulsion grains. However, the present invention is not limited to those specific examples. Hexachloroiridium (III) or (IV) Complex Salt and Hexaamineiridium (III) or (IV) Complex Salt An amount of the iridium complex added is preferably in a range from $10^{-9}$ mol to $10^{-4}$ mol, and more preferably in a range from $10^{-8}$ mol to $10^{-5}$ mol per one mol of the silver halide except for a case where the iridium complex comprises at least two cyan ligands set forth below.

The metal complex contained in the silver halide emulsion grains used in the present invention that is advantageously used is at least one selected from the group consisting of metal complexes of Fe, Ru, Re, Os and Ir each comprising at least two cyan ligands, by the considerations that high sensitivity can be achieved and that formation of the fogging can be restricted even during a long-time storage of a raw photo-sensitive material. The metal complex is represented by the following general formula [C-I].

$$[M^1(CN)_{6-a}L_a]^n,$$

wherein $M^1$ represents Fe, Ru, Re, Os or Ir, L represents a ligand other than CN, a represents 0, 1 or 2, and n represents −2, −3 or −4.

Examples of the metal complex comprising at least two cyan ligands that is used in the present invention are set forth below. As a counter ion to the metal complex, alkali metal ions are advantageously used such as ammonium, sodium and potassium.

Metal Complex with two or more Cyan Ligands $[Fe(CN)_6]^{-4}$
$[Fe(CN)_6]^{-3}$
$[Ru(CN)_6]^{-4}$
$[Ru(CN)_5F]^{-4}$
$[Ru(CN)_4F_2]^{-4}$
$[Ru(CN)_5Cl]^{-4}$
$[Ru(CN)_4Cl_2]^{-4}$
$[Ru(CN)_5(OCN)]^{-4}$
$[Ru(CN)_5(SCN)]^{-4}$
$[Re(CN)_6]^{-4}$
$[Re(CN)_5Br)^{-4}$
$[Re(CN)_4Br_2]^{-4}$
$[Os(CN)_6]^{-4}$
$[Os(CN)_5\ I]^{-4}$
$[Os(CN)_4I_2]^{-4}$
$[Ir(CN)_6]^{-3}$
$[Ir(CN)_5(N_3)]^{-3}$
$[Ir(CN)_5(H_2O)]^{-3}$ A content of at least one selected from the group consisting of metal complexes of Fe, Ru, Re, Os and Ir each comprising at least two cyan ligands preferably ranges from $10^{-6}$ mol to $10^{-3}$ mol, both inclusive, and more preferably from $5\times10^{-6}$ mol to $5\times10^{-4}$ mol, both inclusive, per one mol of the silver halide.

The metal complex comprising at least two cyan ligands used in the present invention may be contained in and added to the silver halide emulsion grains in any stages before and after preparation of them, i.e., the nucleation, growth, physical ripening and chemical sensitization. The metal complex may be added at once or at several times. In the present invention, 50% or more of the total contents of the metal complex comprising at least two cyan ligands contained in the silver halide grains is preferably contained in a surface layer of which volume is not higher than 50% of a grain volume. The term "surface layer of which volume is not larger than 50% of a grain volume" used herein means surface areas of which volume is not larger than 50% of a volume of one grain. The volume of the surface layer is preferably not larger than 40%, and more preferably not larger than 20%. In addition, one or more layers having no metal complex may be provided outside the surface layer containing the metal complex defined above.

The metal complex used is preferably dissolved in water or an adequate solvent and added directly to a reaction solution in formation of the silver halide grains. Alternatively, the metal complex may be incorporated to the grain by means of adding it to an aqueous solution of halogen compounds, an aqueous solution of silver or any other solution and thereby forming grains. In addition, the silver halide grains in which the metal complex is previously contained are added to and dissolved in a reaction solution to accumulate them on other silver halide grains. This also permits the latter silver halide grains to contain the metal complex.

In the present invention, pH of the coating of the silver halide color photographic photo-sensitive material corresponds to pH of all photographic structural layers obtained by means of applying a coating solution to a support and is thus not necessarily identical to pH of the coating solution. The pH of the coating can be measured through a following method disclosed in JP-A-61-245153. More specifically, (1) 0.05 ml of pure water is dropped to a surface of the photo-sensitive material to which the silver halide emulsion is applied. (2) After being let stand for three minutes, pH of the coating is measured by using a coating pH measuring electrodes (GS-165F, available from TOA Electronics Ltd., Tokyo).

The photo-sensitive material according to the present invention has the so measured coating pH of from 4.0 to 6.5. Preferably, this pH ranges from 5.0 to 6.5.

The coating pH may be adjusted by using acid (e.g., sulfuric acid, citric acid, etc.) or alkali (e.g., sodium hydroxide, potassium hydroxide, etc.). While the acid or the alkali may be added to the coating solution by using any one of suitable methods, it is typically added to the solution in preparation thereof. In addition, the coating solution to which the acid or the alkali is added may be the solution for any one or more of the photographic structural layers.

Preferable mercapto heterocyclic compound used in the present invention is represented by the following general formula (V):

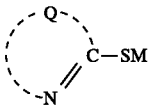

(V)

wherein Q represents atomic groups required for forming a five- or six-membered heterocyclic ring or five- or six-membered heterocyclic ring to which a benzene ring is condensed, and M represents a cation.

The compound having the general formula (V) is described more specifically.

A heterocyclic ring formed by Q may be, for example, an imidazole ring, a tetrazole ring, a thiazole ring, an oxazole ring, a selenazole ring, a benzoimidazole ring, a naphthoimidazole ring, a benzothiazole ring, a benzoselenazole ring, a naphthoselenazole ring or a benzoxazole ring.

A cation represented by M may be, for example, a hydrogen ion, alkali metals (such as sodium and potassium) or an ammonium group.

The compound represented by the general formula (V) is preferably a mercapto compound represented by one of the following general formulae (V-1), (V-2), (V-3) and (V-4).

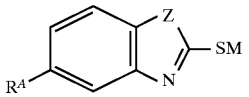

(V-1)

wherein $R^A$ represents a hydrogen atom, an alkyl group, an alkoxy group, an aryl group, a halogen atom, a carboxyl group or a salt thereof, a sulfo group or a salt thereof, or an amino group; Z represents —NH—, —OH— or —S—; and M is similar to that in the general formula (V).

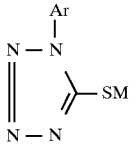

(V-2)

wherein Ar represents

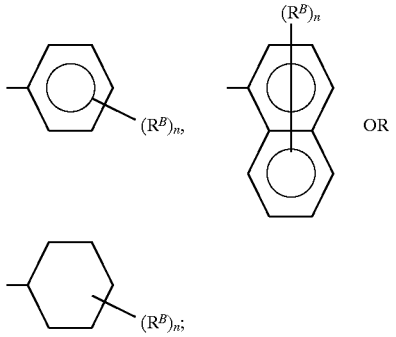

$R^B$ represents an alkyl group, an alkoxy group, a carboxyl group or a salt thereof, a sulfo group or a salt thereof, a hydroxyl group, an amino group, an acylamino group, a carbamoyl group or a sulfamide; n represents an integer of from 0 to 2; and M is similar to that in the general formula (V).

In the general formulae (V-1) and (V-2), the alkyl group represented by $R^A$ and $R^B$ includes, for example, methyl, ethyl and butyl. The alkoxy group represented by $R^A$ and $R^B$ includes, for example, methoxy and ethoxy. A salt of the carboxyl group or the sulfo group includes, for example, a sodium salt and an ammonium salt.

In the general formula (V-1), the aryl group represented by $R^A$ includes, for example, phenyl and naphthyl while the halogen atom represented by $R^A$ includes, for example, a chloride atom and a bromide atom.

In the general formula (V-2), the acylamino group represented by $R^B$ includes, for example, methylcarbonylamino and benzoylamino while the carbamoyl group represented by $R^8$ includes, for example, ethylcarbamoyl and phenylcarbamoyl. The sulfamide represented by $R^B$ includes, for example, methylsulfamido and phenylsulfamido.

The above mentioned alkyl, alkoxy, aryl, amino, acylamino, carbamoyl groups and the sulfamide may have one or more substituents. The substituent may be, in the amino group for example, the amino group of which alkylcarbamoyl group is substituted, i.e., an alkyl-substituted ureido group.

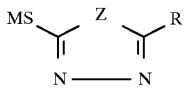

(V-3)

wherein Z represents —N($R^{A1}$)—, an oxygen atom or a sulfur atom. R represents a hydrogen atom, an alkyl group, an aryl group, an alkenyl group, a cycloalkyl group, —$S^{A1}$—, —N($R^{A2}$)$R^{A3}$—, —NHCO$R^{A4}$—, —$NHSO_2$, $R^{A5}$ or a heterocyclic group; $R^{A1}$ represents a hydrogen atom, an alkyl group, an alkenyl group, a cycloalkyl group, an aryl group, —CO$RA^{A4}$ or —$SO_2R^{A5}$; $R^{A2}$ and $R^{A3}$ each represents a hydrogen atom, an alkyl group or an aryl group; and $R^{A4}$ and $R^{A5}$ each represents an alkyl group or an aryl group. M is similar to that in the general formula (V).

In the general formula (V-3), the alkyl group of $R^{A1}$, $R^{A2}$, $R^{A3}$, $R^{A4}$ or $R^{A5}$ may be, for example, methyl, benzyl, ethyl or propyl, and the aryl group may be, for example, phenyl or naphthyl.

In addition, the alkenyl and cycloalkyl groups of R or $R^{A1}$ may be, for example, propenyl and cyclohexyl, respectively. The heterocyclic group of R may be, for example, furyl or pyridinyl.

The alkyl and aryl groups each represented by $R^{A1}$, $R^{A2}$, $R^{A3}$, $R^{A3}$, $R^{A4}$ or $R^{A5}$, the alkenyl and cycloalkyl groups each represented by R or $R^{A1}$ and the heterocyclic group represented by R may have one or more substituents.

(V-4)

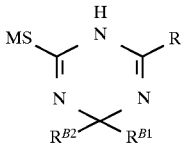

wherein R and M are same as R and M in the general formula (V-3), respectively; $R^{B1}$ and $R^{B2}$ are same as $R^{A1}$ and $R^{A2}$ in the general formula (V-3), respectively.

Specific examples of the compound represented by the general formula (V) are given below. It should be noted that the present invention is not limited to those specific examples.

V-1-1

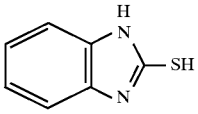

V-1-2

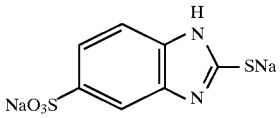

V-1-3

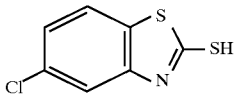

V-1-4

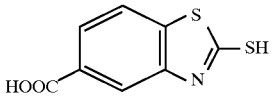

V-1-5

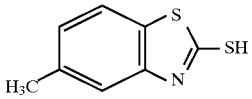

V-1-6

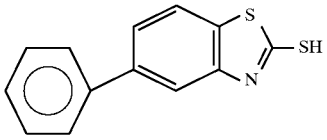

V-1-7

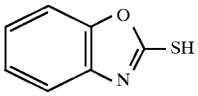

V-1-8

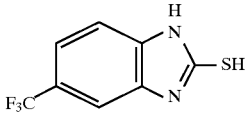

-continued

V-2-1

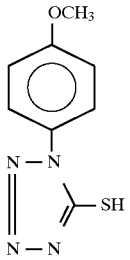

V-2-2

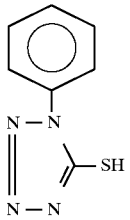

V-2-3

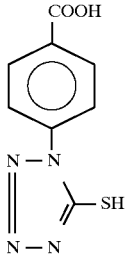

V-2-4

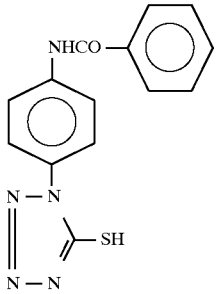

V-2-5

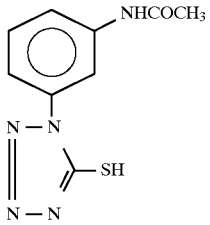

V-2-6

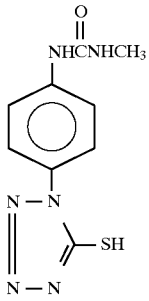

| COMPOUND | R | M |
|---|---|---|
| | 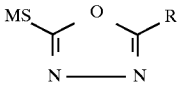 | |
| V-3-1 | $-C_2H_5$ | $-H$ |
| V-3-2 | $-CH_2-CH=CH_2$ | $-H$ |
| V-3-3 | $-CH=CH-CH_2-CH_3$ | $-H$ |
| V-3-4 | $-C_7H_{15}$ | $-H$ |
| V-3-5 | $-C_9H_{19}$ | $-Na$ |
| V-3-6 | 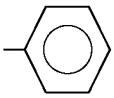 | $-H$ |
| V-3-7 | $-C_4H_9(t)$ | $-H$ |
| V-3-8 | 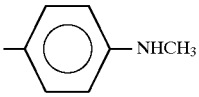 | $-H$ |
| V-3-9 | 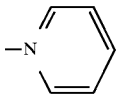 | $-H$ |
| V-3-10 | 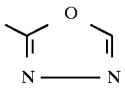 | $-H$ |
| V-3-11 | 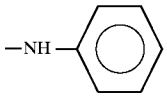 | $-H$ |
| V-3-12 | 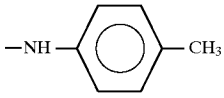 | $-NH_4$ |
| V-3-13 | $-NHCOCH_3$ | $-H$ |
| V-3-14 | 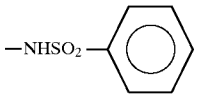 | $-H$ |
| V-3-15 | $-N(CH_3)_2$ | $-H$ |
| V-3-16 | 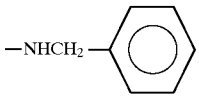 | $-H$ |
| V-3-17 | 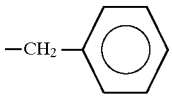 | $-H$ |
| V-3-18 | $-S-CH_3$ | $-H$ |
| V-3-19 | 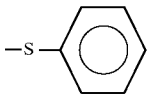 | $-H$ |
| V-3-20 | $-SH$ 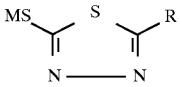 | $-H$ |
| V-3-21 | $-H$ | $-H$ |

-continued
| | | |
|---|---|---|
| V-3-22 | $-C_2H_5$ | $-H$ |
| V-3-23 | $-C_4H_9(t)$ | $-H$ |
| V-3-24 | $-C_6H_{13}$ | $-H$ |
| V-3-25 | 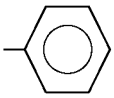 | $-H$ |
| V-3-26 | 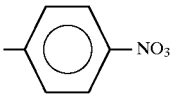 | $-H$ |
| V-3-27 | 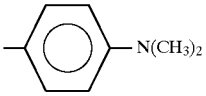 | $-H$ |
| V-3-28 | 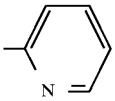 | $-H$ |
| V-3-29 | 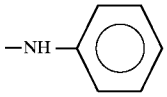 | $-H$ |
| V-3-30 | $-NH_2$ | $-H$ |
| V-3-31 | $-CH_2CH=CH_2$ | $-H$ |
| V-3-32 | $-SH$ | $-H$ |
| V-3-33 | $-NHCOC_2H_5$ | $-H$ |
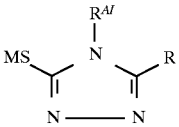
| COMPOUND | R | $R^{A1}$ | M |
|---|---|---|---|
| V-3-34 | $-C_2H_5$ | $-H$ | $-H$ |
| V-3-35 | $-CH_3$ | $-CH_3$ | $-H$ |
| V-3-36 | $-CH_3$ | 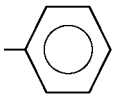 | $-H$ |
| V-3-37 | $-NHCOCH_3$ | $-CH_3$ | $-H$ |
| V-3-38 | 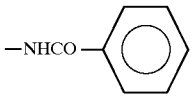 | 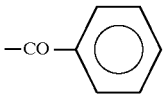 | $-H$ |
| V-3-39 | $-NHCOCH_3$ | $-COCH_3$ | $-H$ |
| V-3-40 | $-NHCOCH_3$ | 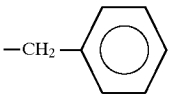 | $-H$ |
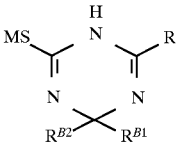
| COMPOUND | R | $R^{B1}$ | $R^{B2}$ | M |
|---|---|---|---|---|
| V-4-1 | $-C_2H_5$ | $-CH_3$ | $-CH_3$ | $-H$ |

-continued

| | | | | |
|---|---|---|---|---|
| V-4-2 | 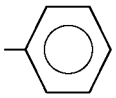 | $-CH_3$ | $-CH_3$ | $-H$ |
| V-4-3 | $-NH_2$ | $-H$ | 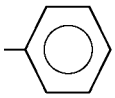 | $-H$ |
| V-4-4 | 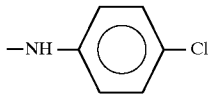 | $-H$ | $-C_4H_9$ | $-H$ |
| V-4-5 | $-NHCOCH_3$ | $-CH_3$ | $-CH_3$ | $-H$ |
| V-4-6 | 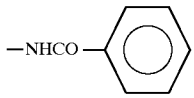 | $-CH_3$ | $-CH_3$ | $-H$ |
| V-4-7 | 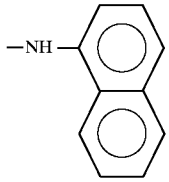 | $-CH_3$ | $-C_3H_7(i)$ | $-H$ |
| V-4-8 | 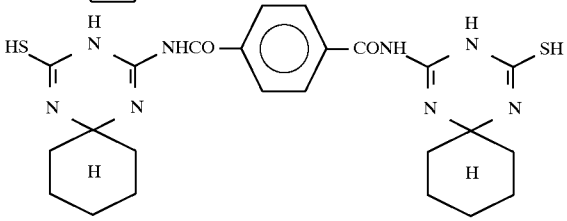 | | | |

An amount of the compound represented by the general formula (V) added is preferably from $1\times10^{-5}$ to $5\times10^{-2}$ mol, and more preferably from $1\times10^{-4}$ to $1-10^{-2}$ mol, per one mol of the silver halide. A method of addition is not limited to a specific one and the compound may be added in any stages of formation of the silver halide grains, physical ripening, chemical ripening and preparation of the coating solution.

In the photo-sensitive material according to the present invention, it is preferable to add dyes adapted to be decolored by photographic processing (oxonol dyes or cyanine dyes), disclosed in European Patent Publication No. 0,337,490A2, pages 27–76, to a hydrophilic colloidal layer to avoid irradiation or halation and to improve safelight immunity. In addition, dyes that are contained in the hydrophilic colloidal layer in a form of a solid particle dispersion and that are decolored by the photographic processing may also be used advantageously. Such dyes include those disclosed in JP-A-2-282244, page 3, an upper right column to page 8, and those disclosed in JP-A-3-7931, page 3, an upper right column to page 11, a lower left column. These dyes, if used, preferably have such absorption that includes a spectral sensitivity maximum of a layer sensitive to a longest wavelength. To improve sharpness, it is preferable to use these dyes for setting an optical density (a logarithm of an inverse number of transmitted light) of the photo-sensitive material (or a reflection density if a reflecting material is used) at 680 nm or at a laser wavelength used for exposure to 0.5 or higher.

The photo-sensitive material according to the present invention preferably contains non-diffusion cyan, magenta and yellow couplers.

A high-boiling organic solvent for photographic additives such as the cyan, magenta and yellow couplers used in the present invention may be any one of adequate good solvents for couplers that is immiscible to water and has a melting point of not higher than 100° C. and a boiling point of not lower than 140° C. The melting point of the high-boiling organic solvent is preferably not higher than 80° C. The boiling point of the high-boiling organic solvent is preferably not lower than 160° C., and more preferably not lower than 170° C.

Details for such high-boiling organic solvent are disclosed in JP-A-62-215272, page 137, a lower right column to page 144, an upper right column.

The cyan, magenta or yellow coupler may be emulsified and dispersed in a hydrophilic colloidal solution by means of impregnating in a loadable latex polymer (e.g., U.S. Pat. No. 4,203,716) in the presence or absence of the above mentioned high-boiling organic solvent, or alternatively, by means of dissolving together with an insoluble and organic-solvent soluble polymer.

Preferably, a homopolymer or a copolymer is used as those disclosed in U.S. Pat. No. 4,856,449 and International Patent Publication No. WO 88/00723, pages 12–30. It is particularly preferable to use a methacrylate or acrylamide polymer, especially the acrylamide polymer by the consideration of color image stability.

In addition, it is preferable to use together with the couplers a color image storability improving compounds such as those disclosed in European Patent Publication No. 0,277,589A2. In particular, such improving compounds may be advantageously used with pyrazoloazole couplers or pyrroloazole couplers. More specifically, it is preferable, for preventing any adverse effects such as staining because of color generating dyes formed as a result of a reaction of the couplers with color developing agents left in the layer or oxidants thereof during storage after processing, to use single or a combination of a compound capable of chemically bonding to the aromatic amine developing agents left after color developing processing, thereby producing substantially colorless and chemically inactive compounds and/or a compound capable of chemically bonding to the oxidants of the aromatic amine developing agents left after color developing processing, thereby producing substantially colorless and chemically inactive compounds.

It is also preferable to add mildew proofing agents as disclosed in JP-A-63-271247 to the photo-sensitive material according to this invention so as to eliminate the problem of mildew, or bacteria growing in the hydrophilic colloidal layer, which otherwise may be a cause of image deterioration.

As the support used for the photo-sensitive material of the present invention, a substrate may be used in which a white polyester support or a layer containing white dyes for displaying is provided on the support at the side having the silver halide emulsion layer. To further improve the sharpness, it is preferable to form by coating an anti-halation layer on the side coated with the silver halide emulsion layer or on the back side of the support. The transmission density of the support is preferably within the range from 0.35 to 0.8 to ensure a clear view on the display regardless of whether the light is a transmission light or a reflecting light.

The photo-sensitive material according to the present invention may be exposed to visible light or to an infrared ray. An exposure method may be a low illumination intensity exposure or a high illumination intensity-short time exposure. For the latter case, a laser scanning exposure is preferable in which an exposure time for one pixel is shorter than $10^{-4}$ seconds.

A band stop filter disclosed in U.S. Pat. No. 4,880,726 may advantageously be used in exposure. This eliminates light color amalgamation, resulting in remarkable improvement of color reproducibility.

The exposed photo-sensitive material is preferably subjected to bleach-fixing process after color development to achieve rapid processing. In particular, when the above mentioned high silver chloride emulsion is used, pH of a bleach-fixing solution is preferably not larger than 6.5, and more preferably not larger than 6 to enhance removal of silver.

Those disclosed in the published Japanese patent applications and the European Patent Publication No. 0,355,660 (JP-A-2-139544) are preferable examples of the silver halide emulsion, other materials (additives), photograph forming layers (layer structure or the like), and the methods and the processing additives applied to process the photo-sensitive material.

TABLE 1

| PHOTOGRAPH COMPONENTS | JP-A-62-215272 | JP-A-2-33144 | EP 355660 A2 |
|---|---|---|---|
| Silver Halide Emulsion | p.10, l.6 of URC to p.12, l.5 of LLC; and p.12, 4th line from bottom of LRC to p.13 l.17 of ULC | p.28, l.16 of URC to p.29, l.11 of LRC; and p.30, ll.2–5 | p.45, l.53 to p.47 l.3; and p.47, ll.20–22 |

TABLE 1-continued

| PHOTOGRAPH COMPONENTS | JP-A-62-215272 | JP-A-2-33144 | EP 355660 A2 |
|---|---|---|---|
| Silver Halide Solvent | p.12, ll.6–14 of LLC and p.13, 3rd line from bottom of ULC to p.18, last line of LLC | — | — |
| Chemical Sensitizer | p.12, 3rd line from bottom of LLC to 5th line from bottom of LRC; and p.18, l.1 of LRC to p.22, 9th line from bottom of URC | p.29, ll.12 to last line of LRC | p.47, ll.4–9 |
| Spectral Sensitizer (Spectral Sensitization) | p.22, 8th line from bottom of URC to p.38, last line | p.30, ll.1–13 of ULC | p.47, ll.10–15 |
| Emulsion Stabilizer | p.39, l.1 of ULC to p.72, last line of URC | p.30, l.14 of ULC to l.1 of URC | p.47, ll.16–19 |
| Development Accelerator | p.72, l.1 of LLC to p.91, l.3 of URC | — | — |

* ULC = upper left column; URC = upper right column; LLC = lower left column; LRC = lower right column

TABLE 2

| PHOTOGRAPH COMPONENTS | JP-A-62-215272 | JP-A-2-33144 | EP 355660 A2 |
|---|---|---|---|
| Color Couplers (Cyan, Magenta, Yellow Couplers) | p.91, l.4 of URC to p.121, l.6 of ULC | p.3, l.14 of URC to p.18, last line of ULC; and p.30, l.6 of URC to p.35, l.11 of LRC | p.4, ll.15–27; p.5, l.30 to p.28, last line; p.45, ll.29–31; and p.47, l.23 to p.63, l.50 |
| Color Generation Accelerator | p.121, l.7 of ULC to p.125, l.1 of URC | — | — |
| Ultraviolet Light Absorbing Agent | p.125, l.2 of URC to p.127, last line of LLC | p.37, l.14 of LRC to p.38, l.11 of ULC | p.65, ll.22–31 |
| Anti-fading Agent (Image Stabilizer) | p.127, l.1 of LRC to p.137, l.8 of LLC | p.36, l.12 of URC to p.37, l.19 of ULC | p.4, l.30 to p.5, l.23; p.29, l.1 to p.45, l.25; p.45, ll.33–40; and p.65, ll.2–21 |
| High-boiling and/or Low-boiling Organic Solvent | p.137, l.9 of LLC to p.144, last line of URC | p.35, l.14 of LRC to p.36, 4th line from bottom of ULC | p.64, ll.1–51 |
| Dispersion Methods for Photographing Additives | p.144, l.1 of LLC to p.146, l.7 of URC | p.27, l.10 of LRC to p.28, last line of ULC; and p.35, l.12 of LRC to p.36, l.7 of URC | p.63, l.51 to p.64, l.56 |

TABLE 3

| PHOTOGRAPH COMPONENTS | JP-A-62-215272 | JP-2-33144 | EP 355660 A2 |
|---|---|---|---|
| Hardening Agent | p.146, l.8 of URC to p.155, | — | — |

TABLE 3-continued

| PHOTOGRAPH COMPONENTS | JP-A-62-215272 | JP-2-33144 | EP 355660 A2 |
|---|---|---|---|
| | l.4 of LLC | | |
| Developing Agent Precursor | p.155, l.5 of LLC to p.155, l.2 of LRC | — | — |
| Development Inhibitor Releasing Compound | p.155, ll.3–9 of LRC | — | — |
| Support | p.155, l.19 of LRC to p.156, l.14 of ULC | p.38, l.18 of URC to p.39, l.3 of ULC | p.66, l.29 to p.67, l.13 |
| Photo-sensitive material Layer Structure | p.156, l.15 of ULC to p.156, l.14 of LRC | p.28, ll.1–15 of URC | p.45, ll.41–52 |
| Dye | p.156, l.15 of LRC to p.184, last line of LRC | p.38, l.12 of ULC to l.7 of URC | p.66, ll.18–22 |
| Color Mixing Inhibitor | p.185, l.1 of ULC to p.188, l.3 of LRC | p.36, ll.8–11 of URC | p.64, l.57 to p.65, l.1 |
| Gradation Adjusting Agent | p.188, ll.4–8 of LRC | — | — |

TABLE 4

| PHOTOGRAPH COMPONENTS | JP-A-62-215272 | JP-A-2-33144 | EP 355660 A2 |
|---|---|---|---|
| Stain Inhibitor | p.188, l.9 of LRC to p.193, l.10 of LRC | p.37, last line of ULC to l.13 of LRC | p.65, l.32 to p.66, l.17 |
| Surfactant | p.201, l.1 of LLC to p.210, last line of URC | p. 18, l.1 of URC to p.24, last line of LRC; and p.27, 10th line from bottom of LLC to l.9 of LRC | — |
| Fluorine-containing Compound (antistatic agent, coating aid, lubricant, adhesion inhibitor, etc.) | p.210, l.1 of LLC to p. 222, l.5 of LLC | p.25, l.1 of ULC to p.27, l.9 of LRC | — |
| Binder (hydrophilic colloid) | p.222, l.6 of LLC to p.225, last line of ULC | p.38, ll.8–18 of URC | p.66, ll.23–28 |
| Thickening Agent | p.225, l.1 of URC to p.227, l.2 of URC | — | — |
| Antistatic Agent | p.227, l.3 of URC to p.230, l.1 of ULC | — | — |

TABLE 5

| PHOTOGRAPH COMPONENTS | JP-A-62-215272 | JP-A-2-33144 | EP 355660 A2 |
|---|---|---|---|
| Polymer Latex | p.230, l.2 of ULC to p.239, last line | — | — |
| Matte Agent | p.240, l.1 of ULC to p.240, last line of URC | — | — |
| Photographic Processing Methods (process and additives) | p.3, l.7 of URC to p.10, l.5 of URC. | p.39, l.4 of ULC to p.42, last line of ULC | p.67, l.14 to p.69, l.28 |

NOTE:
Citations from JP-A-62-215272 includes the amended contents in the Amendment of March 16, 1987, printed at the end of this publication.
Also for the color couplers, it is preferable to use as the yellow coupler a so-called short-wave type yellow coupler disclosed in JP-A-63-231451, JP-A-63-123047, JP-A-63-241547, JP-A-1-173499, JP-A-1-213648 and JP-A-1-250944.

As the cyan coupler, other than diphenylimidazole cyan couplers disclosed in JP-A-2-33144, advantageously used are 3-hydroxypyridine cyan couplers disclosed in European Patent Publication No. 0,333,185 (in particular, preferable are a 2-equivalent coupler produced by means of adding a chloride removal group to a 4-equivalent coupler of a coupler (42) and couplers (6) and (9) disclosed as specific examples); cyclic active methylene cyan couplers disclosed in JP-A-64-32260 (in particular, couplers 3, 8 and 34 disclosed as specific examples are preferable); pyrrolopyrazole cyan couplers disclosed in European Patent Publication No. 0,456,226A1; pyrroloimidazole cyan couplers disclosed in European Patent No. 0,484,909; and pyrrolotriazole cyan couplers disclosed in European Patent No. 0,488,248 and European Patent Publication No. 0,491,197A1. Of these, the pyrrolotriazole cyan couplers are significantly preferable.

As the yellow coupler, other than the compounds set forth in the above Tables, advantageously used are acylacetoamide yellow couplers having a 3- to 5-membered ring structure at an acyl group disclosed in European Patent Publication No. 0,447,969A1; malondianilide yellow coupler having a ring structure disclosed in European Patent Publication No. 0,482,552A1; and acylacetoamide yellow couplers having a dioxane structure disclosed in U.S. Pat. No. 5,118,599. of these, it is preferable to use acylacetoamide yellow couplers of which acyl group is 1-alkylcyclopropane-1-carbonyl group, and malondianilide yellow coupler in which one of anilides form an indoline ring. These couplers may be used solely or as a combination of two or more.

The magenta coupler used in the present invention may be 5-pyrazolone magenta couplers or pyrazoloazole magenta couplers disclosed in the articles set forth in the above Tables. Of these, advantageously used by the considerations of hues, image stability and color generation stability are pyrazolotriazole couplers disclosed in JP-A-61-65245 in which a secondary or tertiary alkyl group is directly bonded to a 2-, 3- or 6-coordinate of a pyrazolotriazole ring; pyrazoloazole couplers containing sulfamides in molecules disclosed in JP-A-61-65246; pyrazoloazole couplers having an alkoxyphenylsulfamideparasod disclosed in JP-A-61-147254; and pyrazoloazole couplers having an alkoxy group or an aryloxy group at a 6-coordinate disclosed in European Patent No. 226,849A.

As the color photo-sensitive material according to the present invention, other than those disclosed in the above Tables, preferable processing materials and processing methods are disclosed in JP-A-2-207250, page 26, line 1 of a lower right column to page 34, line 9 of an upper right column; and JP-A-4-97355, page 5, line 17 of an upper left column to page 18, line 20 of a lower right column.

The color developers used in the present invention preferably contain organic preservatives rather than hydroxylamine or sulfite ions.

The term "organic preservatives" used herein means any organic compounds having capabilities of reducing deterioration rate of the aromatic primary amine color developing agent when added to the processing solution for the color photographic photo-sensitive material. More specifically, the organic preservatives may be organic compounds having functions of avoiding oxidation of the color developing agent due to air or the like. Of these, particularly effective organic preservatives include hydroxylamine derivatives (except for hydroxylamine), hydroxamic acids, hydrazines, hydrazides, α-amino acids, phenols, α-hydroxyketones, α-aminoketones, sugars, monoamines, diamines, polyamines, quaternary ammonium salts, nitroxy radicals, alcohols, oximes, diamide compounds and condensed ring amines. These are disclosed in, for example, JP-B-48-30496 (the term "JP-B" as used herein means an "examined" Japanese patent publication), JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-1-97953, JP-A-1-186939, JP-A-1-186940, JP-A-1-187557, JP-A-2-306244, and European Patent Publication No. 0,530,921A1. In addition, as the preservatives, various metals disclosed in JP-A-57-44148 and JP-A-57-53749; salicylic acids disclosed in JP-A- 59-180588; amines disclosed in JP-A-63-239447, JP-A-63-128340, JP-A-1-186939 and JP-A-1-187557; alkanolamines disclosed in JP-A-54-3532; polyethyleneimines disclosed in JP-A-56-94349; and aromatic polyhydroxy compounds disclosed in U.S. Pat. No. 3,746,544 may be used if necessary. In particular, it is preferable to add following compounds: alkanolamines such as triethanolamine, dialkylhydroxylamine such as N,N-diethylhydroxylamine and N,N-di(sulfoethyl)hydroxylamine, α-amino acid derivatives such as glycine, alanine, leucine, serine, threonine, valine, isoleucine and aromatic polyhydroxy compounds such as catechol-3,5-disulfonyl soda.

In particular, to use dialkylhydroxylamine together with alkanolamines, or to use dialkylhydroxylamine disclosed in European Patent Publication No. 0,530,921A1 together with alkanolamines and α-amino acids represented by glycine is preferable in view of improving stability of the color developer and improving stability in a continuous processing accordingly.

An amount of the preservatives added may be any one of suitable amounts for exhibiting functions of avoiding degradation of the color developing agents. The amount is preferably from 0.01 to 1.0 mol/liter, and more preferably from 0.03 to 0.30 mol/liter.

The present invention will be more readily apparent in the context of a specifically delineated set of examples and a reference. However, it should be understood that the present invention is not limited to those particular examples.

EXAMPLE 1

Silver halide emulsions were prepared in a manner described below.

(Preparation of Silver Chlorobromide Emulsion A)

17.6 g of sodium chloride was added to 1600 ml of a lime-treated gelatin 3%-aqueous solution, to which an aqueous solution containing 0.094 mol of silver nitrate and an aqueous solution containing 0.12 mol of sodium chloride were added and mixed at 65° C. while stirring strongly. Subsequently, an aqueous solution containing 0.85 mol of silver nitrate and an aqueous solution containing 1.15 mol of sodium chloride were added to the resultant solution and mixed at 65° C. while stirring strongly. Then, desalting was performed by means of precipitation washing at 40° C. In addition, 90.0 g of lime-treated gelatin was added. Sensitizing dyes A and B as set forth below were added to the resultant emulsion by an amount of $2\times10^{-4}$ mol per one mol of the silver halide. Then, silver bromide fine grain emulsion having grain size of 0.07 μm was added by an amount corresponding to of 0.005 mol of silver to form silver bromide rich areas on silver chloride host grains, following which a sulfur sensitizer, a selenium sensitizer and a gold sensitizer were added. The resultant mixture was subjected to optimum chemical sensitization at 60° C.

In this way, the silver chlorobromide emulsion A (cubic grains; average grain size: 0.69 μm (side length); average volume of volume load: 0.33 $\mu m^3$; fluctuation coefficient of grain size distribution: 0.08) was prepared.

(Preparation of Silver Chlorobromide Emulsion B)

An emulsion was prepared as a silver chlorobromide emulsion B that was different from the silver chlorobromide emulsion A only in that $K_4Fe(CN)_6$ was added to the sodium chloride solution of second addition by an amount corresponding to $2.0\times10^{-5}$ mol per one mol of silver halide product. In this way, the silver chlorobromide emulsion B (cubic grains; average volume of volume load: 0.33 $\mu m^3$; fluctuation coefficient of grain size distribution: 0.08) was prepared.

(Preparation of Silver Chlorobromide Emulsion C)

A gelatin solution [containing 1200 ml of water, 6 g of empty gelatin, 0.5 g of NaCl; pH 9.0] was poured into a reaction vessel and temperature was kept at 65° C., to which an $AgNO_3$ solution (0.1 g/ml of $AgNO_3$) and an NaCl solution (0.0345 g/ml of NaCl) were added and mixed simultaneously while stirring at a rate of 15 ml/min. over 12 minutes. Next, a gelatin solution [containing 100 ml of water, 19 g of empty gelatin, 1.3 g of NaCl] was added to the mixture, to which an $HNO_3$.1N solution was added to adjust pH to 4.0. Subsequently, the temperature was increased to 70° C. and the solution was ripened for 16 minutes, to which fine grain emulsion described below was added by an amount corresponding to 0.1 mol of the silver halide. After ripening for 15 minutes, 0.15 mol of the fine grain emulsion was added and the solution was ripened for 15 minutes. This was repeated two times. After 2-minute ripening, the temperature was lowered to 45° C. Then, NaOH was added to adjust pH to 5.2, to which the sensitizing dyes A and B as set forth below were added by an amount of $3\times10^{-4}$ mol per one mol of the silver halide. After stirring for 15 minutes, 0.01 mol of KBr solution (KBr 1 g/100 ml) was added and stirred for 5 minutes. A precipitating agent was added and the temperature and pH were lowered to 27° C. and 4.0, respectively. The emulsion was washed with water according to a standard precipitation washing method. A gelatin solution was added to the emulsion and the temperature was increased to 40° C. to adjust pH and pCl of the emulsion to 6.4 and 2.8, respectively. Next, the temperature was increased to 55° C. Subsequently, the sulfur sensitizer, the selenium sensitizer and the gold sensitizer were added to the emulsion to perform optimum chemical ripening.

The emulsion so prepared was subjected to observation through an electron microscope (TEM). As a result, 80% of all silver halide emulsion grains is constituted by tabular silver halide grains having {100} planes as main planes of which average grain diameter was 1.4 μm, average aspect ratio was 6.5 and average grain volume was 0.33 $\mu m^3$.

The average aspect ratio used herein is an average value of the aspect ratio of the grains having the aspect ratio of 1.5 or higher measured on five hundred grains extracted randomly.

The fine grain emulsion was prepared in a following manner. A gelatin solution [containing 1200 ml of water, 24 g of gelatin (M3) having an average molecular weight of 30,000, 0.5 g of NaCl; pH 3.0] was poured into a reaction vessel and temperature was kept at 23° C., to which an $AgNO_3$ solution (containing 0.2 g/ml of $AgNO_3$, 0.01 g/ml of M3 and 0.25 ml/100 ml of $HNO_3$.1N solution) and an NaCl solution (containing 0.07 g/ml of NaCl, 0.01 g/ml of M3 and 0.25 ml/100 ml of KOH.1N solution) were added and mixed simultaneously while stirring at a rate of 90 ml/min. over 3.5 minutes. After stirring for 1 minute, pH and pCl of the emulsion were adjusted to 4.0 and 11.7, respectively.

(Preparation of Silver Chlorobromide Emulsions D and E)

Emulsions were prepared as silver chlorobromide emulsions D and E that were different from the silver chlorobromide emulsion C only in that metal complexes set forth in Table 6 were previously added to the fine grain emulsion to be added. In the silver chlorobromide emulsions D and E, 80% of all silver halide emulsion grains is constituted by tabular silver halide grains having {100} planes as main planes, of which average grain diameter was 1.4 $\mu$m, average aspect ratio was 6.5 and average grain volume was 0.33 $\mu m^3$.

(Preparation of Silver Chlorobromide Emulsion F)

A gelatin solution [containing 1200 ml of water, 20 g of deionized alkali treated gelatin (hereinafter, referred to as EA-Gel), 0.8 g of NaCl; pH 6.0] was poured into a reaction vessel and temperature was kept at 60° C., to which an Ag-1 solution and an X-1 solution were added and mixed simultaneously while stirring at a rate of 50 ml/min. over 15 seconds.

In this event, the Ag-1 solution was [containing 20 g of $AgNO_3$, 0.6 g of a low molecular weight gelatin having an average molecular weight of 20,000 (hereinafter, referred to as M2-Gel), and 0.2 ml of $HNO_3$.1N solution in 100 ml of water] and the X-1 solution was [containing 7 g of NaCl and 0.6 g of M2-Gel in 100 ml of water].

Next, an Ag-2 [containing 4 g of $AgNO_3$, 0.6 g of M2-Gel, and 0.2 ml of $HNO_3$.1N solution in 100 ml of water] solution and an X-2 solution [containing 2.8 g of KBr and 0.6 g of M2-Gel in 100 ml of water] were added and mixed simultaneously while stirring at a rate of 70 ml/min. over 15 seconds. Subsequently, the Ag-1 solution and the X-1 solution were added and mixed simultaneously while stirring at a rate of 25 ml/min. over 2 minutes, to which 15 ml of NaCl (0.1 g/ml) solution was added. Then, the temperature was increased to 70° C. and the solution was ripened for 5 minutes, to which the Ag-1 solution and the X-1 solution were added and mixed simultaneously while stirring at a rate of 10 ml/min. over 15 minutes. Subsequently, to grow tabular grains, 0.2 mol of AgCl fine grain emulsion was added. The AgCl grains have the average size of 0.07 $\mu$m and are formed such that the ratio of the grains, which are not twining crystal and containing no screw dislocation, is equal to or higher than 99.9%. After 15-minute ripening, the temperature and pH were lowered to 40° C. and 2.0, respectively. This solution was stirred for 20 minutes and then pH was adjusted to 5.2, to which $1^{-3}$ mol of KBr-1 solution (1 g/100 ml of KBr) was added. The resultant solution was stirred. Next, the sensitizing dyes A and B as set forth below were added by an amount of $3\times10^{-4}$ mol per one mol of the silver halide. A precipitating agent was added and the emulsion was then washed with water according to a standard method. The resultant emulsion was subjected to optimum gold-sulfur sensitization with the sulfur sensitizer and the gold sensitizer. The emulsion so prepared was subjected to observation through an electron microscope (TEM). As a result, it was revealed that 80% of a total projection area of all silver halide emulsion grains is constituted by tabular silver halide grains having {100} planes as main planes, having a right-angled parallelogram shape and having an average aspect ratio of 3 or greater. An average grain diameter of each grain was 1.35 $\mu$m, average aspect ratio was 6.5 and average grain volume was 0.32 $\mu m^3$. In addition, the fluctuation coefficient of the grain size distribution of the tabular grains was 0.28.

(Preparation of Silver Chlorobromide Emulsions G through L)

Emulsions were prepared as silver chlorobromide emulsions G through L that were different from the silver chlorobromide emulsion F only in that metal complexes set forth in Table 6 were previously added to the fine grain emulsion to be added. According to electron microscope observation on the silver chlorobromide emulsions G through L, it was revealed that 80% of a total projection area of all silver halide emulsion grains is constituted by tabular silver halide grains having {100} planes as main planes, having a right-angled parallelogram shape and having an average aspect ratio of 3 or greater. An average grain diameter of each grain was 1.35 $\mu$m, average aspect ratio was 6.5 and average grain volume was 0.32 $\mu m^3$. In addition, the fluctuation coefficient of the grain size distribution of the tabular grains was 0.28.

(Preparation of Silver Chlorobromide Emulsion M)

A silver chlorobromide emulsion M was prepared in the same manner as the silver chlorobromide emulsion F except that an X-3 solution [containing 11.3 g of NaCl, 0.3 g of KI and 0.6 g of M2-Gel in 100 ml of water] was used in place of the X-2 solution.

According to electron microscope observation on the silver chlorobromide emulsion M, 60% of a total projection area of all silver halide emulsion grains is constituted by tabular silver halide grains having {100} planes as main planes, having a right-angled parallelogram shape. An average grain diameter of each grain was 1.45 $\mu$m, average aspect ratio was 7.5 and average grain volume was 0.32 $\mu m^3$. In addition, the fluctuation coefficient of the grain size distribution of the tabular grains was 0.30.

(Preparation of Silver Chlorobromide Emulsions N and O)

Emulsions were prepared as silver chlorobromide emulsions N and O that were different from the silver chlorobromide emulsion M only in that metal complexes set forth in Table 6 were previously added to the fine grain emulsion to be added.

According to electron microscope observation on the silver chlorobromide emulsions N and O it was revealed that 60% of a total projection area of all silver halide emulsion grains is constituted by tabular silver halide grains having {100} planes as main planes, having a right-angled parallelogram shape. An average grain diameter of each grain was 1.45 $\mu$m, average aspect ratio was 7.5 and average grain volume was 0.32 $\mu m^3$. In addition, the fluctuation coefficient of the grain size distribution of the tabular grains was 0.30.

Compositions of the silver chlorobromide emulsions A through O so prepared are set forth in Table 6 below.

TABLE 6

| Emulsion | Grain Shape | Metal Complex | Addition Amount*) (mol/1 mol of silver halide) |
|---|---|---|---|
| A | Cubic | — | — |
| B | Cubic | $K_4Fe(CN)_6$ | $2.0 \times 10^{-5}$ |
| C | {100} Tabular | — | — |
| D | {100} Tabular | $K_2IrCl_6$ | $3.0 \times 10^{-7}$ |
| E | {100} Tabular | $K_4Fe(CN)_6$ | $2.0 \times 10^{-5}$ |
| F | {100} Tabular | — | — |
| G | {100} Tabular | $K_2IrCl_6$ | $3.0 \times 10^{-7}$ |
| H | {100} Tabular | $K_4Fe(CN)_6$ | $2.0 \times 10^{-5}$ |
| I | {100} Tabular | $K_4Os(CN)_6$ | $2.0 \times 10^{-5}$ |
| J | {100} Tabular | $K_3Ru(CN)_6$ | $2.0 \times 10^{-5}$ |
| K | {100} Tabular | $K_3RuCl_6$ | $1.0 \times 10^{-7}$ |
| L | {100} Tabular | $K_3Rh(CN)_6$ | $1.0 \times 10^{-5}$ |
| M | {100} Tabular | — | — |
| N | {100} Tabular | $K_2IrCl_6$ | $3.0 \times 10^{-7}$ |
| O | {100} Tabular | $K_4Fe(CN)_6$ | $2.0 \times 10^{-5}$ |

*)Addition amount is per one mol of silver halide of silver halide grain products.

Both surfaces of a paper support laminated with polyethylene were subjected to corona discharge. Sodium dodecylbenzenesulfonate was then added to gelatin, which was then coated on the surface as a base layer. Various photograph structure layers were coated thereon to make a multilayer color photographic printing paper (Sample 1) having the layer structure as set forth below. Coating solutions were prepared in the manner described below.

Preparation of First Layer Coating Solution 180 ml of ethyl acetate, 24.0 g of a solvent (solv-1) and 24.0 g of a solvent (solv-2) were added to dissolve 153 g of a yellow coupler (ExY), 15.0 g of a color image stabilizer (Cpd-1), 7.5 g of a color image stabilizer (Cpd-2) and 15.8 g of a color image stabilizer (Cpd-3). The resultant solution was added to 560 ml of a 18%-gelatin aqueous solution containing 60.0 ml of 10%-sodium dodecylbenzenesulfonate and log of citric acid. The solution was then emulsified to prepare an emulsified dispersion A.

The above mentioned silver chlorobromide emulsion A and the emulsified dispersion A were mixed and dissolved. Prepared in this way the first layer coating solution has the formulation as set forth below.

The method used for preparing the first layer coating was also used to prepare the second through seventh layers. As the gelatin hardening agent, 1-oxy-3,5-dichloro-s-triazine sodium salt was used.

In addition, Cpd-15 and Cpd-16 were added to each layer in the total amounts of 25.0 mg/$M^2$ and 50.0 mg/$M^2$, respectively.

Spectral sensitizing dyes as set forth below were used as the silver chlorobromide emulsion for the individual sensitive emulsion layers.

TABLE 7

BLUE-SENSITIZING EMULSION LAYER

SENSITIZING DYE A

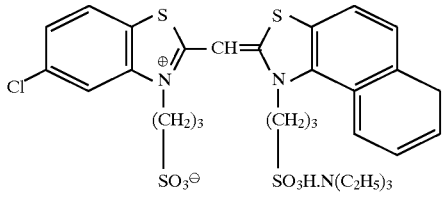

and

SENSITIZING DYE B

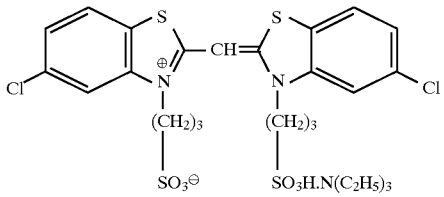

TABLE 8

GREEN-SENSITIZING EMULSION LAYER

SENSITIZING DYE C

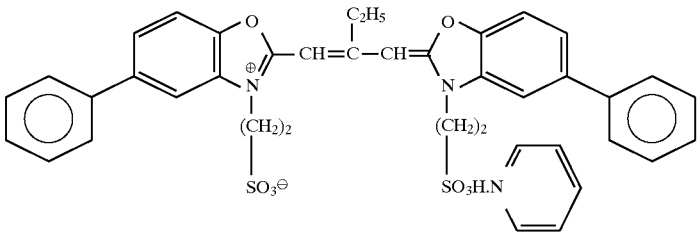

$4.0 \times 10^{-4}$ mol and $5.6 \times 10^{-4}$ mol per 1 mol of silver halide for the large-size and the small-size emulsions, respectively.

TABLE 8-continued

| GREEN-SENSITIZING EMULSION LAYER |
|---|
| SENSITIZING DYE D |
| 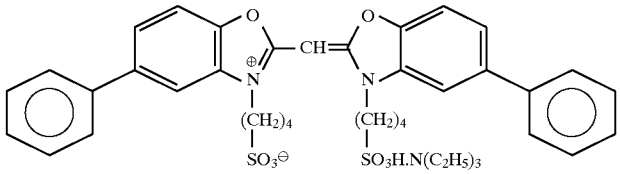 |
| $7.0 \times 10^{-5}$ mol and $1.0 \times 10^{-4}$ mol per 1 mol of silver halide for the large-size and the small-size emulsions, respectively. |

TABLE 9

| RED-SENSITIZING EMULSION LAYER |
|---|
| SENSITIZING DYE E |
| 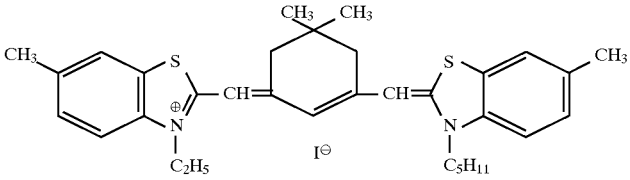 |
| $0.9 \times 10^{-4}$ mol and $1.1 \times 10^{-4}$ mol per 1 mol of silver halide for the large-size and the small-size emulsions, respectively. In addition, a following compound was added at $2.6 \times 10^{-3}$ mol per 1 mol of silver halide |
| 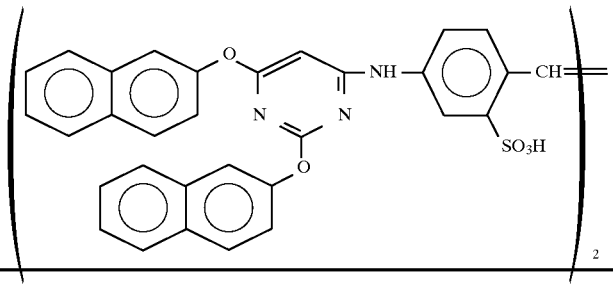 |

In addition, 1-(5-methylureidophenyl)-5-mercaptotetrazole was added to the green-, and red-sensitive emulsion layers at $7.7\times10^{-4}$ mol and $3.5\times10^{-4}$ mol, respectively, per 1 mol of silver halide.

Further, 4-hydroxy-6-methyl-1,3,3a,7-tetraazaindene was added to the blue-, green- and red-sensitive emulsion layers at $1\times10^{-4}$ mol, $2\times10^{-4}$ mol and $1.5\times10^{-4}$ mol, respectively, per 1 mol of silver halide.

Besides, dyes as set forth below were added to the emulsion layers to avoid irradiation. (The numerals within parentheses identify the amount of the dyes coated.)

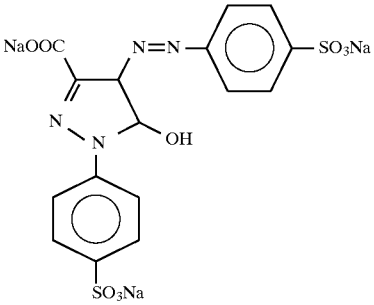

(10 mg/m²)

-continued

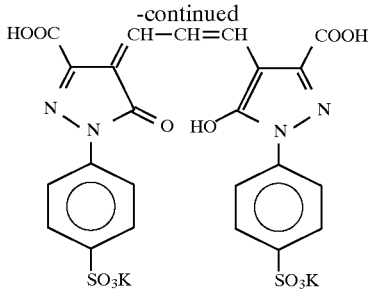

(10 mg/m²)

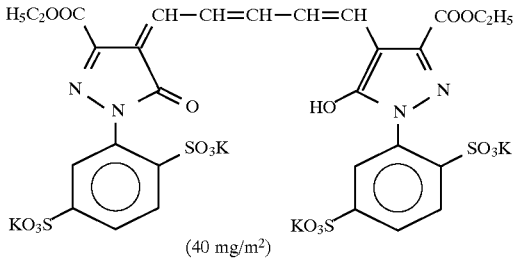

(40 mg/m²)

and

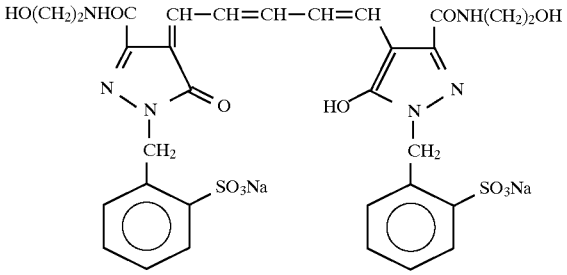

(20 mg/m²)

(LAYER STRUCTURE)

Formulations of the individual layers are set forth below. The numerals identify the coating amount (g/m²). The coating amount of the silver halide emulsion is converted into that of silver.

SUPPORT

Paper laminated with polyethylene (A white dye ($TiO_2$; contents 15% by weight) and a blue-tint dye (ultramarine blue) are contained in the polyethylene at the first layer side)

| | |
|---|---|
| FIRST LAYER (BLUE-SENSITIVE EMULSION LAYER) | |
| Silver Chlorobromide Emulsion | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| SECOND LAYER (COLOR MIXING INHIBITING LAYER) | |
| Gelatin | 1.00 |
| Color Image Stabilizer (Cpd-4) | 0.06 |

-continued

| | |
|---|---|
| Color Image Stabilizer (Cpd-5) | 0.02 |
| Solvent (Solv-2) | 0.20 |
| Solvent (Solv-3) | 0.30 |
| THIRD LAYER (GREEN-SENSITIVE EMULSION LAYER) | |
| Silver Chlorobromide Emulsion (1:3 mixture (silver molar ratio) of a large-size emulsion G1 and a small-size emulsion G2 having average grain sizes of 0.45 μm and 0.29 μm, respectively. Fluctuation coefficients of the grain size distribution were 0.08 and 0.10, respectively. In the emulsions, each silver halide grain consists of 0.8 mol % of silver bromide localized at a portion of surfaces of the grains and the remainder being silver chloride.) | 0.13 |
| Gelatin | 1.50 |
| Magenta Coupler (EXM) | 0.16 |
| Color Image Stabilizer (Cpd-2) | 0.03 |
| Color Image Stabilizer (Cpd-6) | 0.15 |
| Color Image Stabilizer (Cpd-7) | 0.01 |
| Color Image Stabilizer (Cpd-8) | 0.02 |
| Color Image Stabilizer (Cpd-9) | 0.07 |
| Solvent (Solv-3) | 0.50 |
| Solvent (Solv-4) | 0.15 |
| Solvent (Solv-5) | 0.15 |
| FOURTH LAYER (COLOR MIXING INHIBITING LAYER) | |
| Gelatin | 0.70 |
| Color Image Stabilizer (Cpd-4) | 0.04 |
| Color Image Stabilizer (Cpd-5) | 0.02 |
| Solvent (Solv-2) | 0.18 |
| Solvent (Solv-3) | 0.18 |
| Solvent (Solv-7) | 0.02 |
| FIFTH LAYER (RED-SENSITIVE EMULSION LAYER | |
| Silver Chlorobromide Emulsion (8:2 mixture (silver molar ratio) of a large-size emulsion R1 and a small-size emulsion R2 having average grains sizes of 0.5 μm and 0.4 μm, respectively. Fluctuation coefficients of the grain size distribution were 0.09 and 0.10, respectively. In the emulsions, each silver halide grain consists of 0.8 mol % of silver bromide localized at a portion of surfaces of the grains and the remainder being silver chloride). | 0.20 |
| Gelatin | 0.85 |
| Cyan Coupler (EXC) | 0.33 |
| Ultraviolet Light Absorbing Agent (UV-2) | 0.18 |
| Color Image Stabilizer (Cpd-1) | 0.33 |
| Color Image Stabilizer (Cpd-8) | 0.01 |
| Color Image Stabilizer (Cpd-9) | 0.01 |
| Color Image Stabilizer (Cpd-10) | 0.16 |
| Color Image Stabilizer (Cpd-11) | 0.14 |
| Color Image Stabilizer (Cpd-12) | 0.01 |
| Solvent (Solv-1) | 0.01 |
| Solvent (Solv-6) | 0.22 |
| SIXTH LAYER (ULTRAVIOLET LIGHT ABSORBING LAYER) | |
| Gelatin | 0.55 |
| Ultraviolet Light Absorbing Agent (UV-1) | 0.38 |
| Color Image Stabilizer (Cpd-13) | 0.15 |
| Color Image Stabilizer (Cpd-6) | 0.02 |
| SEVENTH LAYER (PROTECTIVE LAYER) | |
| Gelatin | 1.13 |
| Copolymer of Polyvinyl alcohol denatured with acryl (denaturation rate; 17%) | 0.05 |
| Liquid Paraffin | 0.02 |
| Color Image Stabilizer (Cpd-14) | 0.01 |

The compounds used are set forth below.

(ExY) YELLOW COUPLER

1:1:1 MIXTURE (MOLAR RATIO) OF:

-continued
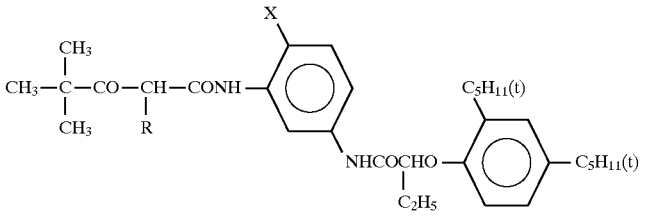
R = 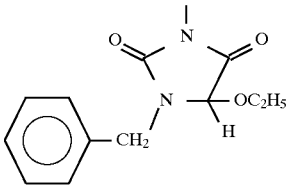 X = Cl
and
R = 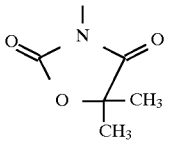 X = $OCH_3$
(ExM) MAGENTA COUPLER
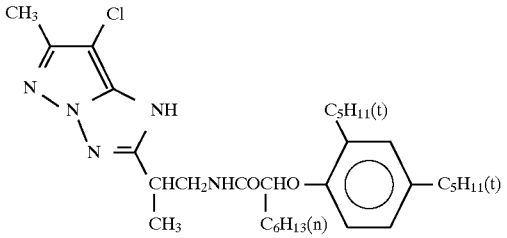
(ExC) CYAN COUPLER
3:7 MIXTURE (MOLAR RATIO) OF:
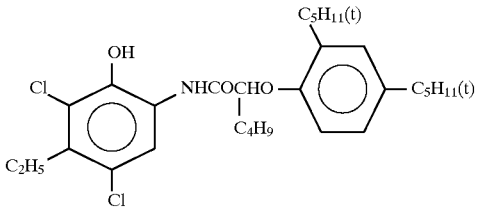
and
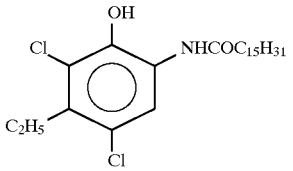
(Cpd-1) COLOR IMAGE STABILIZER
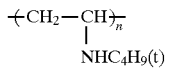
(AVERAGE MOLECULAR WEIGHT 60,000)

-continued
(Cpd-2) COLOR IMAGE STABILIZER
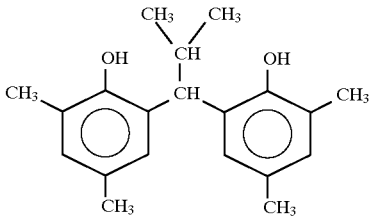
(Cpd-3) COLOR IMAGE STABILIZER
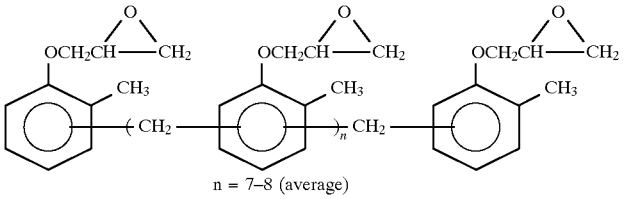
n = 7–8 (average)
(Cpd-4) COLOR MIXING INHIBITOR
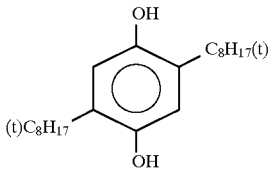
(Cpd-5) COLOR IMAGE STABILIZER
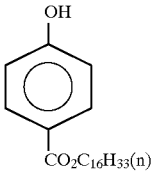
(Cpd-6) COLOR IMAGE STABILIZER
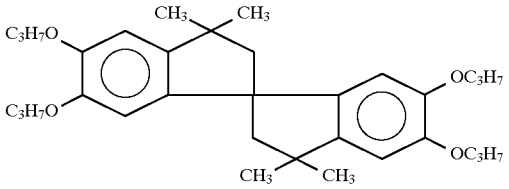
(Cpd-7) COLOR IMAGE STABILIZER
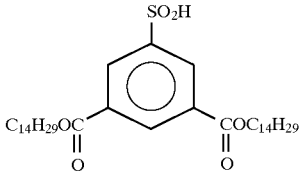
(Cpd-8) COLOR IMAGE STABILIZER
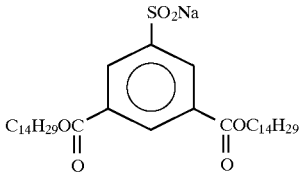

-continued
(Cpd-9) COLOR IMAGE STABILIZER
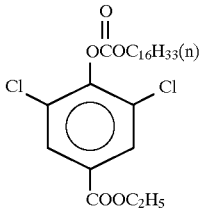
(Cpd-10) COLOR IMAGE STABILIZER
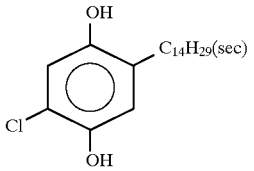
(Cpd-11) COLOR IMAGE STABILIZER
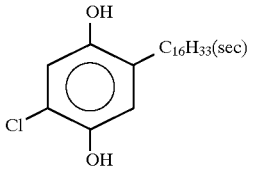
(Cpd-12) COLOR IMAGE STABILIZER
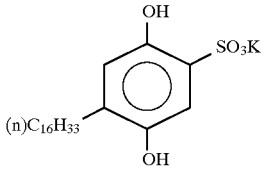
(Cpd-13) COLOR IMAGE STABILIZER
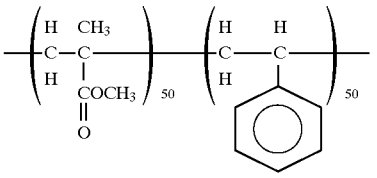
AVERAGE MOLECULAR WEIGHT APPROX. $6.0 \times 10^4$
(Cpd-14) COLOR IMAGE STABILIZER
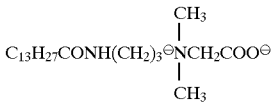
(Cpd-15) ANTISEPTIC
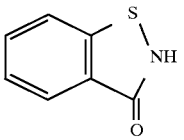

-continued
(Cpd-16) ANTISEPTIC
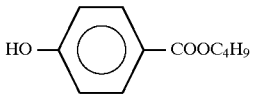
(UV-1) ULTRAVIOLET LIGHT ABSORBING AGENT
1:5:10:5 MIXTURE (WEIGHT RATIO) OF (1), (2), (3) AND (4)
(1)
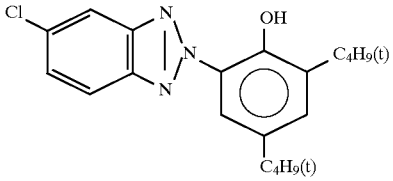
(2)
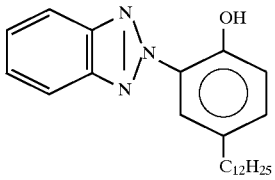
(3)
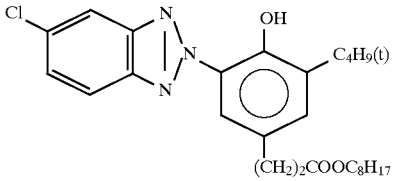
(4)
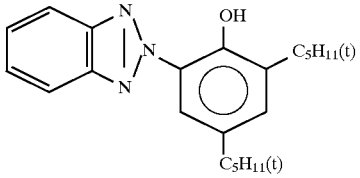
(UV-2) ULTRAVIOLET LIGHT ABSORBING AGENT
1:2:2 MIXTURE (WEIGHT RATIO) OF (1), (2) AND (3)
(1)
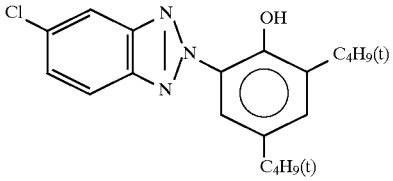
(2)
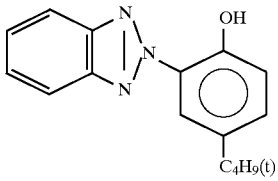
(3)
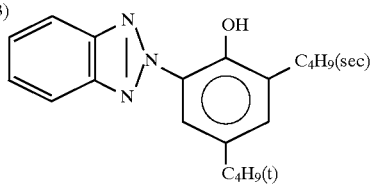
(Solv-1) SOLVENT
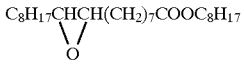
(Solv-2) SOLVENT
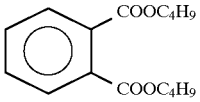
(Solv-3) SOLVENT
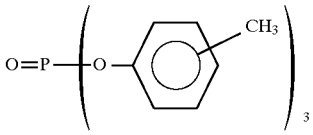

-continued (Solv-4) SOLVENT

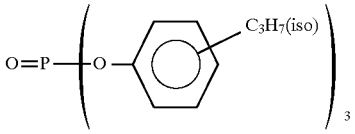

(Solv-5) SOLVENT

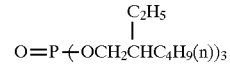

(Solv-6) SOLVENT

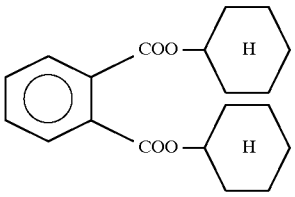

Samples were prepared by means of modifying Sample 1 so prepared in a type of the silver chlorobromide for the first layer (blue-sensitive emulsion layer), a type of the mercapto heterocyclic compound added to the first layer (blue-sensitive emulsion layer) and pH of the coating of the photo-sensitive material as set forth in Table 10 below.

TABLE 10

| Sample | Emulsion | Mercapto Heterocyclic Compound 1) | Coating pH | Sensitivity | ΔD | Fading Rate (%) | Remark |
|---|---|---|---|---|---|---|---|
| 1 | A | V-2-6 | 6.0 | 100 | 0.02 | ○ | Comp. |
| 2 | B | " | 6.0 | 121 | 0.03 | ○ | " |
| 3 | C | " | 6.0 | 180 | 0.09 | ○ | " |
| 4 | D | " | 6.0 | 220 | 0.02 | ○ | Inv. |
| 5 | E | " | 6.0 | 220 | 0.03 | ○ | " |
| 6 | F | none | 6.0 | 180 | 0.08 | ○ | Comp. |
| 7 | " | V-2-6 | 6.0 | 190 | 0.07 | ○ | " |
| 8 | G | " | 6.0 | 250 | 0.01 | ○ | inv. |
| 9 | H | none | 3.8 | 210 | 0.05 | x | Comp. |
| 10 | " | " | 6.0 | 220 | 0.03 | x | " |
| 11 | " | " | 6.7 | 220 | 0.06 | Δ | " |
| 12 | " | V-2-6 | 3.8 | 220 | 0.05 | x | " |
| 13 | " | " | 6.0 | 250 | 0.01 | ○ | Inv. |
| 14 | " | " | 6.7 | 240 | 0.05 | ○ | Comp. |
| 15 | I | " | 3.8 | 220 | 0.04 | x | " |
| 16 | " | " | 4.8 | 260 | 0.02 | ○ | Inv. |
| 17 | " | " | 5.3 | 270 | 0.01 | ○ | " |
| 18 | " | " | 6.2 | 270 | 0.01 | ○ | " |
| 19 | " | " | 6.7 | 260 | 0.05 | ○ | Comp. |
| 20 | J | none | 6.0 | 230 | 0.01 | x | " |
| 21 | " | V-1-5 | 6.0 | 260 | 0.01 | ○ | Inv. |
| 22 | " | V-2-5 | 6.0 | 275 | 0.01 | ○ | " |
| 23 | " | V-3-33 | 6.0 | 255 | 0.01 | ○ | " |
| 24 | " | V-4-6 | 6.0 | 240 | 0.02 | ○ | " |
| 25 | K | V-2-5 | 6.0 | 215 | 0.01 | ○ | Inv. |
| 26 | L | " | 6.0 | 230 | 0.01 | ○ | " |
| 27 | M | V-2-6 | 6.0 | 180 | 0.08 | ○ | Comp. |
| 28 | N | " | 6.0 | 230 | 0.02 | ○ | Inv. |
| 29 | 0 | " | 6.0 | 230 | 0.03 | ○ | " |

1) Added $3 \times 10^{-4}$ mol per 1 mol of silver halide of the blue-sensitive layer
Comp.: Comparative Example
Inv.: Invention To determine the sensitivity of samples so prepared, each sample was subjected to exposure with an optical wedge and blue filter for 1 second and then subjected to color generating development processing by using following processing process and processing solution. The sensitivity was represented as a relative value, wherein the sensitivity of Sample 1 is equal to 100 at an exposing degree required for producing a density which is 1.0 higher than the fogging density.

To evaluate increase of a yellow fogging density during a long-period storage of the photo-sensitive material, each sample was subjected to processing according to the following processing process for individual cases where the samples were stored in an atmosphere of 35° C./55% RH for 3 weeks and where the sample were stored in a refrigerator (10° C.) for the same period. In this event, the processing was made with 0.2 ml/liter of a bleach-fixing solution was incorporated into the color developer intentionally, assuming incorporation during practical color development. Increase of the yellow fogging density was represented as a difference (ΔD) between in the samples stored in the refrigerator and the samples stored in the atmosphere of 35° C./55% RH. The larger value indicates the higher yellow fogging density during a long-time storage of the photo-sensitive material.

To determine the pressure induced desensitization of the photo-sensitive material, it was folded before exposure at an angle of about 35° with the surface inside to which the photographic structural layers were applied, which was then subjected to the exposure and the processing. As evaluation to the pressure induced desensitization, samples folded before exposure were observed by human eyes and following evaluation was given.

○: no desensitization due to folding was found

Δ: desensitization due to folding was slightly found

×: desensitization due to folding was clearly found

| (Process) | (Temperature) | (Time) |
|---|---|---|
| Color Development | 35° C. | 45 sec. |
| Bleach-fix | 30–35° C. | 45 sec. |
| Rinse (1) | 30–35° C. | 20 sec. |
| Rinse (2) | 30–35° C. | 20 sec. |
| Rinse (3) | 30–35° C. | 20 sec. |
| Drying | 70–80° C. | 60 sec. |

Formation of the processing solutions are as follows:

| [Color Developer] | |
|---|---|
| Water | 860 ml |
| Ethylenediamine-N,N,N-N-tetramethylenephosphonic acid | 1.5 g |
| Potassium bromide | 0.015 g |
| Triethanolamine | 8.0 g |
| Sodium Chloride | 1.4 g |
| Potassium Carbonate | 25.0 g |
| N-ethyl-N-(β-methanesulfonamideethyl)-3-methyl-4-aminoaniline sulfate | 5.0 g |
| N,N-bis(carboxymethyl)hydradine | 4.0 g |
| N,N-di(sulfoethyl)hydroxylamine.1Na | |
| Fluorescent Whitening Agent (WHITEX 4B, Sumitomo Chemical Co., Ltd.) | 1.0 g |
| Total (with added water) | 1000 ml |
| pH (25° C.) | 10.05 |
| [Bleach-fixing Solution] | |
| Water | 400 ml |
| Ammonium Thiosulfate (70%) | 100 ml |
| Sodium Sulfite | 17 g |
| Ethylenediaminetetraacetato ferrate (III) Ammonium | 55 g |
| Ferrous disodium ethylenediamine tetraacetate | 5 g |
| Ammonium Bromide | 40 g |
| Total (with added water) | 1000 ml |
| pH (25° C.) | 6.0 |

[Rinse Solution]

Ion Exchange Water (calcium and magnesium are each not higher than 3 ppm)

As apparent from Table 10, the high silver chloride emulsion comprising tabular grains having {100} planes as main planes is highly sensitive (all samples except for Samples 1 and 2). However, the photo-sensitive material to which this emulsion is applied is suffered from increase in fogging density during a long-time storage (Samples 3, 6, 7 and 27). This increase of the fogging density can be reduced significantly by means of making the silver halide grains contain at least one selected from the group consisting of metal complexes of Fe, Ru, Re, Os, Rh and Ir and adjusting pH of the coating of the silver halide color photographic photo-sensitive material to 4.0 to 6.5. However, this also causes the pressure induced desensitization (Samples 10 and 20). The pressure induced desensitization could be improved significantly by means of adding at least one mercapto heterocyclic compound (Samples 4, 5, 8, 13, 16–18, 21–26, 28 and 29).

In addition, as apparent from comparison between Samples 4, 5 and Samples 8, 13, 16–18, 21–26, the higher sensitivity and less increase of the fogging density can be achieved with the emulsion containing the tabular grains having the gap phase discontinuous in halogen composition at a central portion thereof.

EXAMPLE 2

The samples prepared in Example 1 were evaluated by using following processing process and processing solution. Effects of the present invention can be found as in Example 1.

| (Process) | (Temperature) | (Time) |
|---|---|---|
| Color Development | 35° C. | 45 sec. |
| Bleach-fix | 35° C. | 45 sec. |

-continued

| (Process) | (Temperature) | (Time) |
|---|---|---|
| Stabilization (1) | 35° C. | 20 sec. |
| Stabilization (2) | 35° C. | 20 sec. |
| Stabilization (3) | 35° C. | 20 sec. |
| Stabilization (4) | 35° C. | 20 sec. |
| Drying | 80° C. | 60 sec. |

Formulation of the processing solutions are as follows:

| [Color Developer] | |
|---|---|
| Water | 800 ml |
| Poly(styrene lithium sulfonate) solution | 0.25 ml |
| 1-hydroxyethylidene-1,1-diphosphonic acid solution (60%) | 0.8 ml |
| Lithium Sulfate (anhydride) | 2.7 g |
| Triethanolamine | 8.0 g |
| Potassium Chloride | 1.8 g |
| Potassium Bromide | 0.03 g |
| Diethylhydroxylamine | 4.6 g |
| Glycine | 5.2 g |
| Threonine | 4.1 g |
| Potassium Carbonate | 27.0 g |
| Potassium Sulfite | 0.1 g |
| N-ethyl-N-(β-methanesulfonamideethyl)-3-methyl-4-aminoaniline. 3/2 sulfuric acid.1 water salt | 4.5 g |
| Fluorescent Whitening Agent (4',4',-diaminostilbene) | 2.0 g |
| Total (with added water) | 1000 ml |
| pH (25° C.) (adjusted with potassium hydroxide and sulfuric acid) | 10.12 |
| [Bleach-fixing Solution] | |
| Water | 400 ml |
| Ammonium Thiosulfate (700 g/liter) | 100 ml |
| Sodium Sulfite | 17 g |
| Ethylenediaminetetraacetato ferrate (III) Ammonium | 55 g |
| Ferrous disodium ethylenediamine tetraacetate | 5 g |
| Glacial Acetic Acid | 9 g |
| Total (with added water) | 1000 ml |
| pH (25° C.) (adjusted with acetic acid and ammonium) | 5.40 |
| [Stabilizer] | |
| 1,2-Benzisothiazolin-3-one | 0.02 g |
| Polyvinylpyrrolidone | 0.05 g |
| Total (with added water) | 1000 ml |
| pH (25° C.) | 7.0 |

The silver halide color photographic photo-sensitive material according to the present invention is highly sensitive to light, is excellent in storability and is improved in pressure induced desensitization.

What is claimed is:

1. A silver halide color photographic photo-sensitive material comprising a reflective support having thereon photographic structural layers comprising one or more silver halide emulsion layers, wherein:

the pH of the coating of the silver halide color photographic photo-sensitive material ranges from 4.0 to 6.5, and at least one of the silver halide color emulsion layers contains at least one mercapto heterocyclic compound and tabular silver halide grains having {100} planes as main planes and having a silver chloride content of 95 mol % or higher, the silver halide grains containing at least one metal complex selected from the group consisting of metal complexes of Fe, Ru, Re, Os, Rh and Ir, and further wherein, in a silver halide emulsion layer containing the tabular silver halide grains, 35%–100% of a total projection area of all silver halide emulsion grains is occupied by tabular silver halide grains having an aspect ratio (diameter/thickness) of 1.5 or greater, and the tabular silver halide grains are produced by (i) forming seeds having {100} planes, (ii) ripening the seeds and (iii) growing crystals into tabular forms from the seeds, where the tabular grains so produced have at least one gap phase discontinuous in halogen composition at a central portion thereof, said gap being a difference of 10 to 100 mol % in $Cl^-$ content or $Br^-$ content, wherein the gap phase discontinuous in halogen composition is formed by covering a surface of an $AgX_1$ nucleus with at least an $AgX_2$ layer wherein $AgX_1$ represents a silver halide, and $AgX_2$ represents AgBr, AgCl, or AgClBr, and $X_1$ is different from $X_2$ in $Cl^-$ content or $Br^-$ content by from 10 to 100 mol %, whereby a defect in the gap phase-containing central portion causes anisotropic growth of the grain.

2. A silver halide color photographic photo-sensitive material as claimed in claim 1, wherein said gap is a difference of 30 to 100 mol % in $Cl^-$ content or $Br^-$ content.

3. A silver halide color photographic photo-sensitive material as claimed in claim 1, wherein said gap is a difference of 70 to 100 mol % in $Cl^-$ content or $Br^-$ content.

4. A silver halide color photographic photo-sensitive material as claimed in claim 1, wherein the metal complex is an Ir complex.

5. A silver halide color photographic photo-sensitive material as claimed in claim 1, wherein the tabular silver halide grains contain the metal complex in a range from $10^{-8}$ mol to $10^{-2}$ mol per one mol of silver halide.

6. A silver halide color photographic photo-sensitive material as claimed in claim 1, wherein the metal complex is a metal complex having at least two cyanide ligands.

7. A silver halide color photographic photo-sensitive material as claimed in claim 6, wherein the metal complex is represented by the following general formula:

$$[M^1(CN)_{6-a}L_a]^n,$$

wherein $M^1$ represents Fe, Ru, Re, Os or Ir, L represents a ligand other than CN, a represents 0, 1 or 2, and n represents −2, −3 or −4.

8. A silver halide color photographic photo-sensitive material as claimed in claim 7, wherein the tabular silver halide grains contain the metal complex in an amount of from $5\times10^{-6}$ mol to $5\times10^{-4}$ mol per one mol of silver halide.

9. A silver halide color photographic photo-sensitive material as claimed in claim 1, wherein the mercapto heterocyclic compound is represented by the following general formula:

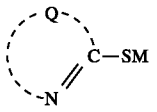

wherein Q represents atomic groups necessary for forming a five- or six-membered heterocyclic ring or five- or six-membered heterocyclic ring to which a benzene ring is condensed, and M represents a cation.

10. A silver halide color photographic photo-sensitive material as claimed in claim 9, wherein the mercapto heterocyclic compound is contained in an amount of from $1\times10^{-5}$ mol to $5\times10^{-2}$ mol per one mol of silver halide.

* * * * *